US011879257B2

(12) United States Patent
Everett et al.

(10) Patent No.: US 11,879,257 B2
(45) Date of Patent: Jan. 23, 2024

(54) SHIPPING CONTAINER BASED PORTABLE TEMPORARY/RELIEF HOUSING UNIT

(71) Applicants: Steve T. Everett, Farmington, NY (US); Robert E. Reed, Farmington, NY (US)

(72) Inventors: Steve T. Everett, Farmington, NY (US); Robert E. Reed, Farmington, NY (US)

( * ) Notice: Subject to any disclaimer, the term of this patent is extended or adjusted under 35 U.S.C. 154(b) by 0 days.

(21) Appl. No.: 17/557,279

(22) Filed: Dec. 21, 2021

(65) Prior Publication Data

US 2022/0205262 A1 Jun. 30, 2022

Related U.S. Application Data

(60) Provisional application No. 63/130,641, filed on Dec. 26, 2020.

(51) Int. Cl.
*E04H 1/12* (2006.01)

(52) U.S. Cl.
CPC ... *E04H 1/1205* (2013.01); *E04H 2001/1283* (2013.01)

(58) Field of Classification Search
CPC . E04H 1/1205; E04H 2001/1283; E04H 1/02; E04B 1/34861; E04B 1/34321; E04B 2001/34389
See application file for complete search history.

(56) References Cited

U.S. PATENT DOCUMENTS

| | | | | |
|---|---|---|---|---|
| 3,835,600 | A | 9/1974 | Padula et al. | |
| 4,599,829 | A | 7/1986 | DiMartino, Sr. | |
| 4,660,332 | A | 4/1987 | Colvin, Jr. | |
| 4,841,897 | A | 6/1989 | Clafin | |
| 4,891,919 | A | 1/1990 | Palibroda | |
| 5,345,730 | A | 9/1994 | Jurgensen | |
| 5,706,614 | A | 1/1998 | Wiley, Jr. et al. | |
| 5,706,615 | A | 1/1998 | Bridges et al. | |
| 5,765,316 | A | 6/1998 | Kavarsky | |
| 5,984,587 | A | 11/1999 | Odle | |
| 6,253,499 | B1 * | 7/2001 | Sidy | E04H 1/1205 52/169.4 |
| 6,513,670 | B2 | 2/2003 | Minkkinen | |
| 6,712,414 | B2 | 3/2004 | Morrow | |
| 6,772,563 | B2 | 8/2004 | Kuhn | |
| 6,957,930 | B2 | 10/2005 | Landau | |

(Continued)

FOREIGN PATENT DOCUMENTS

| | | |
|---|---|---|
| JP | 2001115559 | 4/2001 |
| JP | 2005155012 | 6/2005 |
| JP | 2005256534 | 9/2005 |

*Primary Examiner* — Gisele D Ford
(74) *Attorney, Agent, or Firm* — Dawson Law Firm, P.C.; Michael J. Nickerson

(57) ABSTRACT

A transportable modular building includes a shipping container having shipping container frame members defining an outer periphery of the shipping container; shipping container periphery walls extending between the shipping container frame members, and an entry wall unit. The entry wall unit is recessed from the shipping container frame members that form a first side. The entry wall unit includes a door; a solar panel power interface to interface with a solar panel. The shipping container is suitable for national and international conveyance using conventional transportation networks.

18 Claims, 14 Drawing Sheets

(56) References Cited

U.S. PATENT DOCUMENTS

| | | | | |
|---|---|---|---|---|
| 7,240,945 | B1 | 7/2007 | Crean | |
| 7,290,372 | B2 | 11/2007 | Aust et al. | |
| 7,418,802 | B2 | 9/2008 | Sarine et al. | |
| 7,784,845 | B2 | 8/2010 | Kim et al. | |
| 7,828,367 | B2 | 11/2010 | Hickam et al. | |
| 7,882,659 | B2 | 2/2011 | Gyory et al. | |
| 8,186,110 | B2 | 5/2012 | Green | |
| 8,291,647 | B2 | 10/2012 | Esposito | |
| 8,561,358 | B2 | 10/2013 | Rowan | |
| 8,650,806 | B1 * | 2/2014 | Condie | E04H 1/1205 52/79.5 |
| 8,720,126 | B2 | 5/2014 | Strickland et al. | |
| 8,776,449 | B1 | 7/2014 | Rowan | |
| 8,991,134 | B2 | 3/2015 | Wheeler | |
| 9,121,168 | B2 | 9/2015 | Levy et al. | |
| 9,464,428 | B2 | 10/2016 | Esposito | |
| 10,457,188 | B1 | 10/2019 | Mackay | |
| 10,837,168 | B2 | 11/2020 | Rittmanic | |
| 10,851,552 | B1 * | 12/2020 | DeMatteis | E04H 1/1205 |
| 2003/0051417 | A1 | 3/2003 | Ciotti | |
| 2006/0059792 | A1 | 3/2006 | Tiramani | |
| 2006/0225369 | A1 | 10/2006 | Napier | |
| 2007/0170740 | A1 | 7/2007 | DiFranco | |
| 2007/0271857 | A1 | 11/2007 | Heather et al. | |
| 2008/0060790 | A1 * | 3/2008 | Yates | H05K 7/20754 361/679.48 |
| 2008/0134589 | A1 | 6/2008 | Abrams et al. | |
| 2008/0141596 | A1 | 6/2008 | Kelly et al. | |
| 2009/0217600 | A1 | 9/2009 | DeAzambuja | |
| 2010/0011676 | A1 | 1/2010 | Barry | |
| 2010/0024317 | A1 | 2/2010 | Pope | |
| 2010/0064599 | A1 | 3/2010 | Yang et al. | |
| 2011/0023381 | A1 * | 2/2011 | Weber | E04B 1/3431 52/79.5 |
| 2013/0008105 | A1 * | 1/2013 | Thomson | E04H 9/14 52/223.7 |
| 2013/0036702 | A1 * | 2/2013 | Pacetti | E04H 1/1205 52/653.1 |
| 2017/0222598 | A1 * | 8/2017 | Campbell | E04B 1/34336 |
| 2018/0337385 | A1 * | 11/2018 | Schnakofsky | H01M 50/296 |
| 2019/0249413 | A1 | 8/2019 | Brotherton | |
| 2019/0271486 | A1 * | 9/2019 | Tully | F16M 13/02 |
| 2019/0376276 | A1 * | 12/2019 | Lucho Do Valle | E04B 1/34336 |
| 2021/0317651 | A1 * | 10/2021 | Clifton | E04H 1/1205 |
| 2022/0090399 | A1 * | 3/2022 | Nelson | H02S 20/22 |

* cited by examiner

SHIPPING CONTAINER BASED PORTABLE TEMPORARY/RELIEF HOUSING UNIT

PRIORITY INFORMATION

The present application claims priority, under 35 U.S.C. § 119(e), from U.S. Provisional Patent Application, Ser. No. 63/130,641, filed on Dec. 26, 2020. The entire content of U.S. Provisional Patent Application, Ser. 63/130,641, filed on Dec. 26, 2020, is hereby incorporated by reference.

BACKGROUND

Many times following a natural disaster, such as a hurricane, tornado, or earthquake, there is a need for temporary shelter for those who may have lost the use of their homes or residences due to the disaster. The government usually steps in by creating temporary shelters, such as undamaged school gyms, to temporary house a significant number of people for a short period of time. The government has even used sports stadiums, like the Superdome in New Orleans after Hurricane Katherina devastated New Orleans.

Although these shelters can temporary provide a place for displaced people to be protect from the elements and find rest (sleep), these shelters are for housing people for a very short time period. These shelters are ill-equipped to assist a person whose displacement may last weeks or months while their home or residence is being rebuilt.

Moreover, these shelters are open, thereby failing to provide necessary privacy and security to their occupants. Also, these shelters can deprive an individual of their dignity by housing them like livestock.

To address this problem, governments have conventionally purchased temporary housing units, such as trailers which can be transported to the disaster site and set up as temporary housing. However, these trailers are expensive to construct and may not be easily transported in bulk.

To reduce the cost of supplying temporary housing, manufacturers have utilized re-purposed containers, such as shipping container to provide the basic structure of the temporary housing unit. An example of such a unit is disclosed in U.S. Pat. No. 8,186,110. The entire content of U.S. Pat. No. 8,186,110 is hereby incorporated by reference.

Other examples of a shipping container providing the basic structure of a temporary housing unit are disclosed in U.S. Pat. Nos. 6,513,670; 5,706,614; 4,891,919; and 4,599,829. The entire contents of U.S. Pat. Nos. 6,513,670; 5,706,614; 4,891,919; and 4,599,829 are hereby incorporated by reference.

In the various examples disclosed above, the temporary housing units have disadvantages; such as: requiring major modifications to the shipping container which reduce the structural integrity thereof; cost of major modifications to shipping container, thereby increasing the cost of the building; electrical and plumbing systems not self-contained; require an outside source for power; and/or significant set up time when placing the temporary units on site.

More specifically, when modifying the shipping container, by cutting holes in the walls, negatively impacts the structural integrity of the shipping container, thereby preventing the shipping containers from being stacked during transportation due to the possibility of the shipping container collapsing upon itself due to the weight of the containers above it.

Although some conventional housing units have provided reinforcements around such openings, such reinforcements are costly and add time to the construction process. Moreover, the reinforcements do not always provide enough strength to maintain the original structural integrity of the shipping container.

When providing a large number of pre-constructed portable temporary/relief housing units to a disaster area, transportation logistics are a critical gatekeeper. Thus, the ability to ship a large number of pre-constructed portable temporary/relief housing units, in a stacked formation, without concern for self-collapse, is desirable.

Thus, it is desirable to provide a pre-constructed portable temporary/relief housing unit based upon a shipping container that does not require major modifications to the shipping container, thereby retaining its structural integrity.

Furthermore, it is desirable to provide a pre-constructed portable temporary/relief housing unit based upon a shipping container that is not costly to construct.

Also, it is desirable to provide a pre-constructed portable temporary/relief housing unit based upon a shipping container that includes self-contained electrical and plumbing systems.

In addition, it is desirable to provide a pre-constructed portable temporary/relief housing unit based upon a shipping container that includes its own power source.

Lastly, it is desirable to provide a pre-constructed portable temporary/relief housing unit based upon a shipping container that requires little to no time to set up for occupancy.

BRIEF DESCRIPTION OF THE DRAWINGS

The drawings are only for purposes of illustrating various embodiments and are not to be construed as limiting, wherein.

DETAILED DESCRIPTION OF THE DRAWINGS

For a general understanding, reference is made to the drawings. It is noted that the drawings may not have been drawn to scale and that certain regions may have been purposely drawn disproportionately so that the features and concepts may be properly illustrated.

Figure 1:
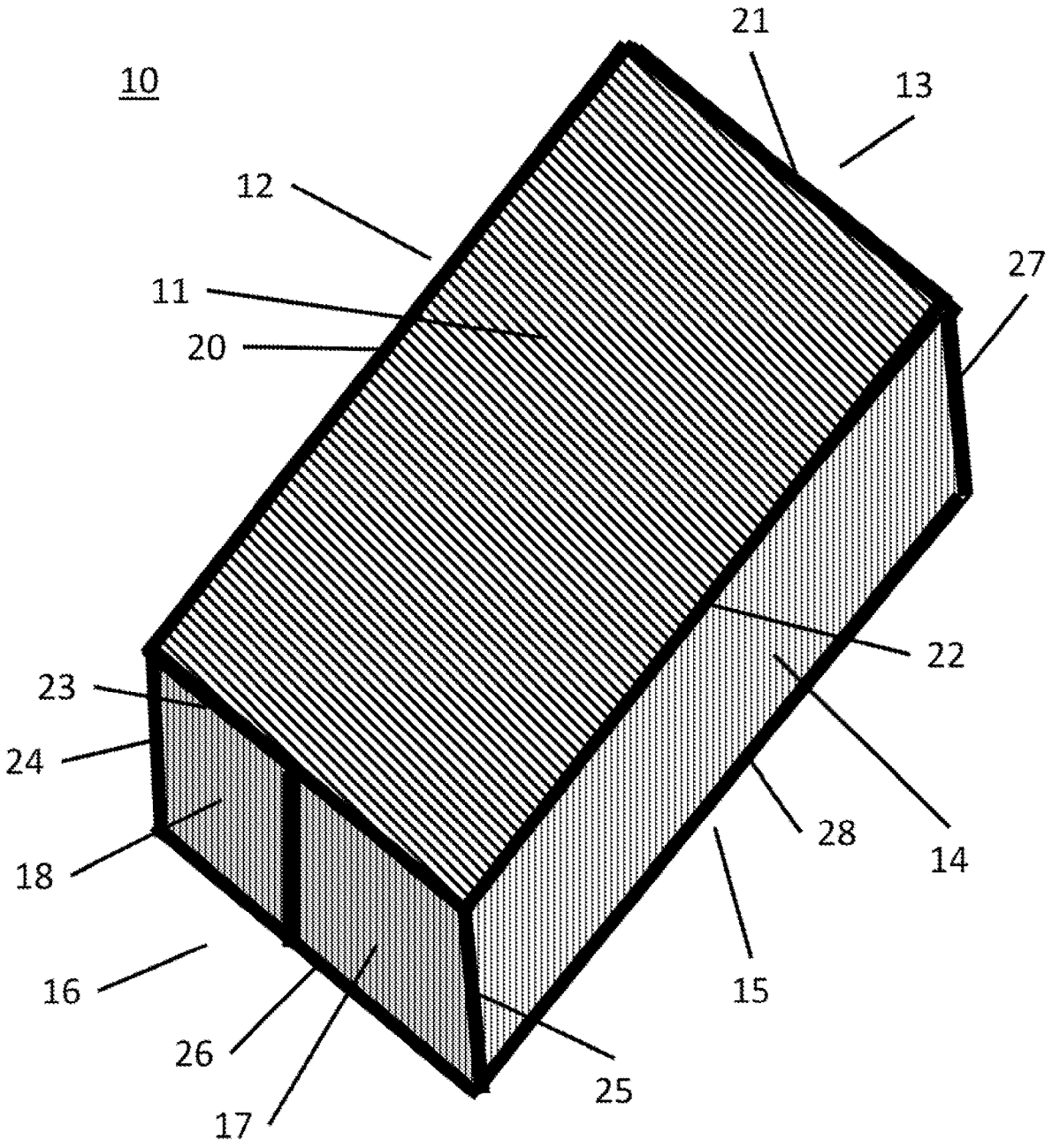
FIGURE 1 (Prior Art)
FIG. 1 illustrates a conventional shipping container.

FIG. 1 illustrates a conventional shipping container 10; such as a Series 1 Freight Container. As illustrated in FIG. 1, the shipping container 10 includes a steel back wall 13, a steel top wall 11, a steel bottom floor 15, and a front face 16 that includes steel doors 17 and 18. The shipping container 10 further includes a first steel side wall 12 and a second steel side wall 14. The shipping container 10 also includes twelve shipping container frame members of which only nine (20, 21, 23, 24, 25, 26, 27, 28, and 29) are illustrated. The steel back wall 13 is connected to illustrated shipping container frame members 21 and 26 and two unillustrated shipping container frame members. The steel top wall 11 is connected to illustrated shipping container frame members 20, 21, 22, and 23. The steel bottom wall 15 is connected to illustrated shipping container frame members 26 and 28 and two unillustrated shipping container frame members. The front face 16 is connected to illustrated shipping container frame members 23, 24, 25, and 26. The first steel side wall 12 is connected to illustrated shipping container frame members 20 and 24 and two unillustrated shipping container frame members. The second steel side wall 14 is connected to illustrated shipping container frame members 22, 25, 27, and 28.

The walls (11, 12, 13, 14, and 15) and the front face 16 (doors 17 and 18) of the shipping container 10 are constructed to rigid specifications to maintain the structural integrity of the shipping container 10. These specifications are not only for ensuring that the shipping container 10 can carry the desired load, but that the shipping container 10 will not collapse upon itself when in transit due to the shipping containers stacked upon it.

Figure 2:
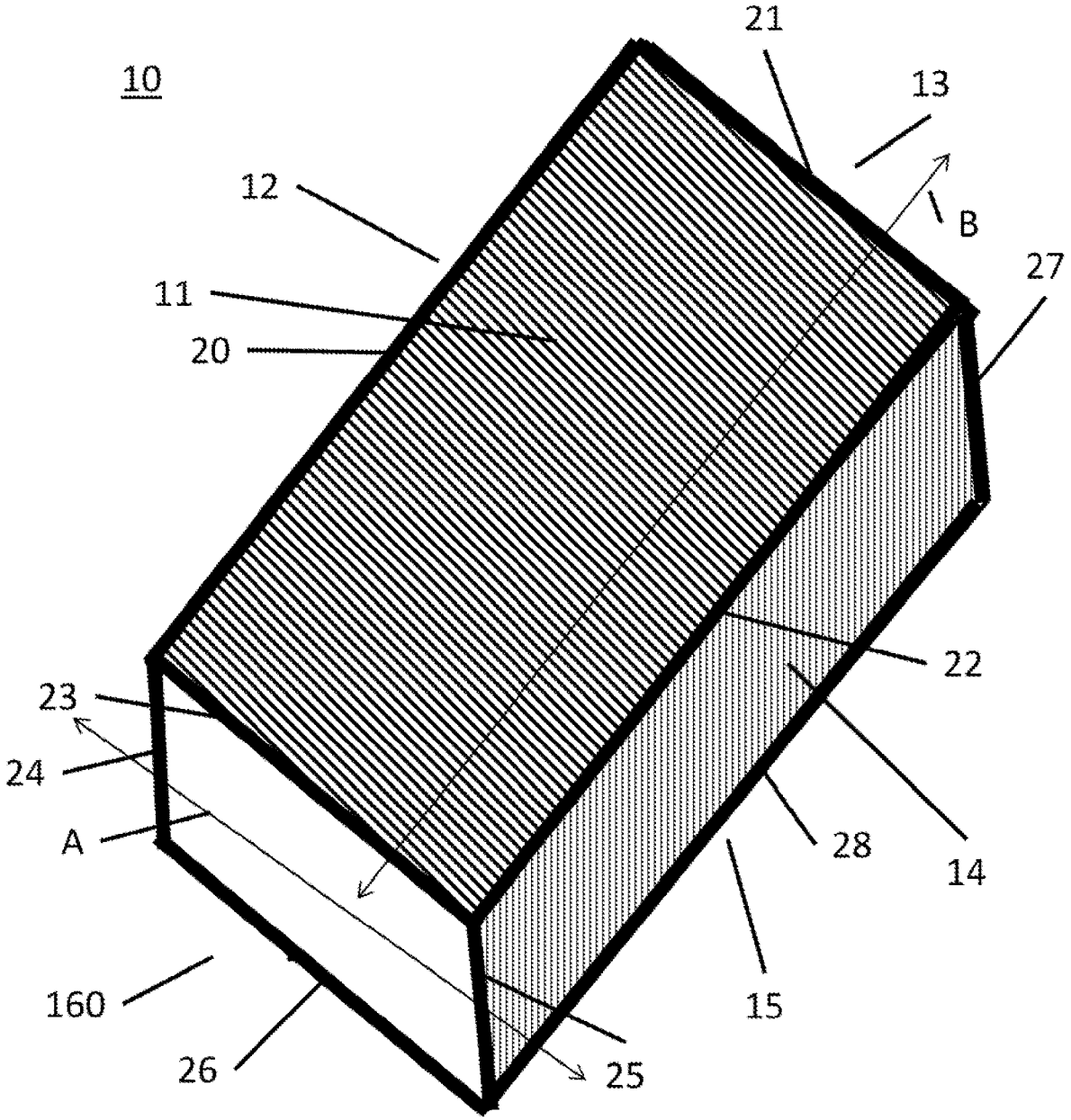
FIG. 2 illustrates a conventional shipping container with its doors removed.

FIG. 2 illustrates a conventional shipping container 10 with its doors removed. As illustrated in FIG. 2, the shipping container 10 includes a steel back wall 13, a steel top wall 11, a steel bottom floor 15, and a front face opening 160 that does not have steel doors. The shipping container 10 further includes a first steel side wall 12 and a second steel side wall 14. Removal of the steel doors may reduce the structural integrity of the shipping container 10, but this is addressed below when constructing the portable temporary/relief housing unit. The shipping container 10 also includes twelve shipping container frame members of which only nine (20, 21, 23, 24, 25, 26, 27, 28, and 29) are illustrated. The steel back wall 13 is connected to illustrated shipping container frame members 21 and 26 and two unillustrated shipping container frame members. The steel top wall 11 is connected to illustrated shipping container frame members 20, 21, 22, and 23. The steel bottom wall 15 is connected to illustrated shipping container frame members 26 and 28 and two unillustrated shipping container frame members. The front face 16 is connected to illustrated shipping container frame members 23, 24, 25, and 26. The first steel side wall 12 is connected to illustrated shipping container frame members 20 and 24 and two unillustrated shipping container frame members. The second steel side wall 14 is connected to illustrated shipping container frame members 22, 25, 27, and 28.

Figure 3:
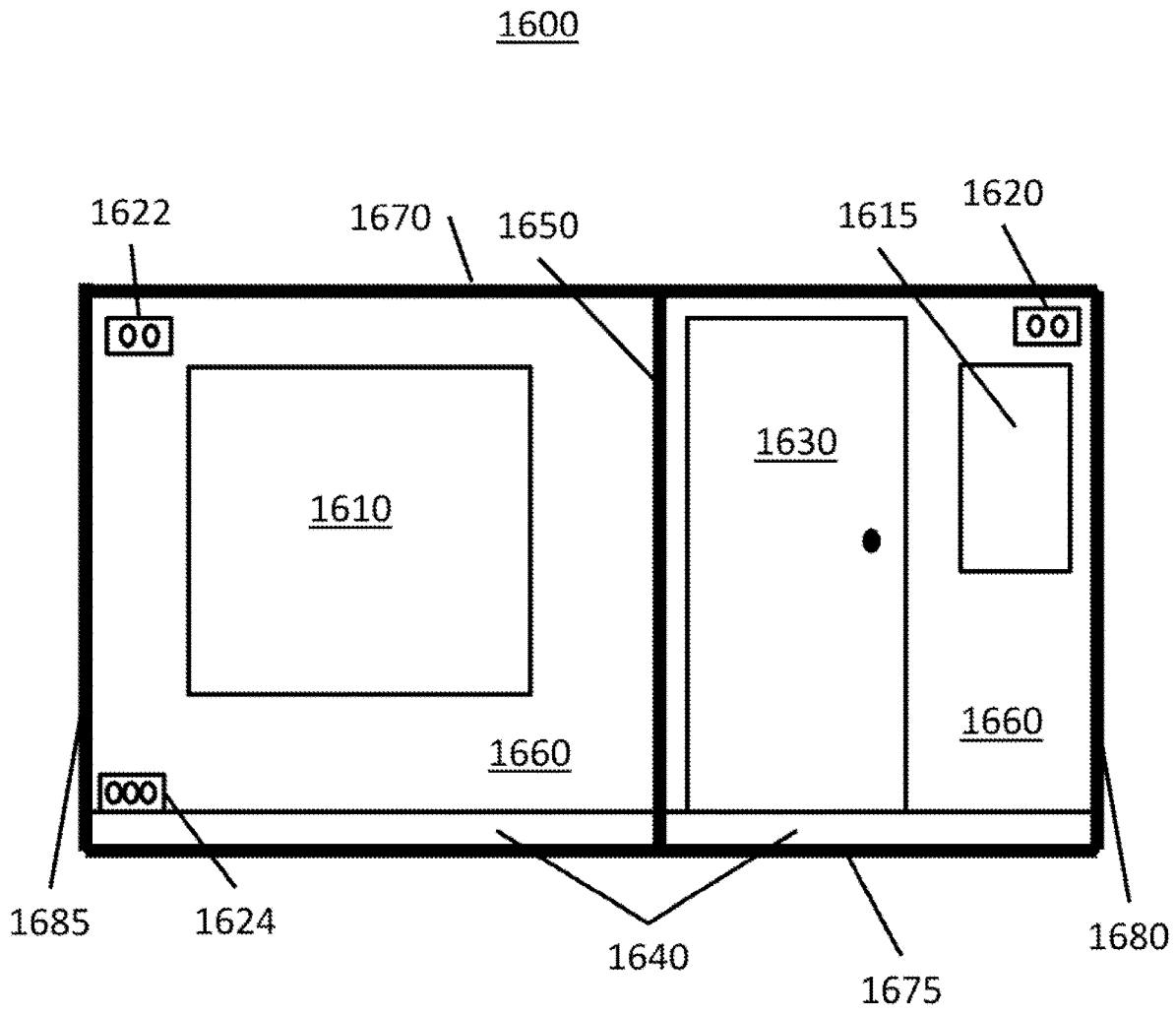
FIG. 3 illustrates an entry wall unit for a pre-constructed portable temporary/relief housing unit based upon a shipping container.

FIG. 3 illustrates an entry wall unit 1600, for placement in the front face opening 160 of FIG. 2, for a pre-constructed portable temporary/relief housing unit based upon a shipping container. As illustrated in FIG. 3, the entry wall unit 1600 includes a wall 1660 and a threshold 1640.

The wall 1660 includes a door 1630, constructed therein, to provide access to the interior of the shipping container. The wall 1660 may include windows 1610 and 1615, constructed therein, to provide sunlight and/or fresh air to the interior of the shipping container.

The entry wall unit 1600 includes a power interface 1622 which includes a solar panel power interface (receptacle) to interface with a solar panel (not shown) (which comes with the pre-constructed portable temporary/relief housing unit) or a power cord (not shown) from a solar panel to enable power transfer from the solar panel to the electrical distribution system (not shown) within the shipping container.

The power interface 1622 may also include an AC power interface (receptacle) to interface with a generator or local utility source (not shown) to enable power transfer to the electrical distribution system (not shown) within the shipping container.

The entry wall unit 1600 may include an air interface 1620 to enable introduction of fresh air to a central air system (not shown) within the pre-constructed portable temporary/relief housing unit and exhaust of stale air from within the pre-constructed portable temporary/relief housing unit.

The entry wall unit 1600 may also include a plumbing interface 1624 to enable introduction of fresh water to the pre-constructed portable temporary/relief housing unit and expel waste water from the pre-constructed portable temporary/relief housing unit.

The connection to an outside source of fresh water and sewage system is not necessary as the pre-constructed portable temporary/relief housing unit is constructed with compost toilets and/or sinks, which collect the waste water in containers that can be removed and emptied into appropriate receptacles outside the pre-constructed portable temporary/relief housing unit.

Moreover, the pre-constructed portable temporary/relief housing unit is constructed with a water tank to provide a supply of fresh water for the pre-constructed portable temporary/relief housing unit. The water tank can be built on a mobile platform so that it be easily removed from the pre-constructed portable temporary/relief housing unit and replaced with a filled water tank.

The entry wall unit 1600 may include reinforcement beams to enhance the structural integrity of the shipping container due to the removal of the doors. For example, a center steel reinforcement beam 1650 may constructed within the wall 1660 to provide vertical strength to the entry wall unit 1600.

The entry wall unit 1600 may also include side steel reinforcement beams 1680 and 1685 constructed within the wall 1660 to provide vertical strength to the entry wall unit 1600.

Lastly, the entry wall unit 1600 may also include a top steel reinforcement beam 1670 constructed within the wall 1660 and a bottom steel reinforcement beam 1675 constructed within the threshold 1640 to provide horizontal strength to the entry wall unit 1600.

The reinforcement beams can be welded to the walls (11, 12, 14, and 15) of the shipping container 10 to secure the entry wall unit 1600 in place.

Figure 4:
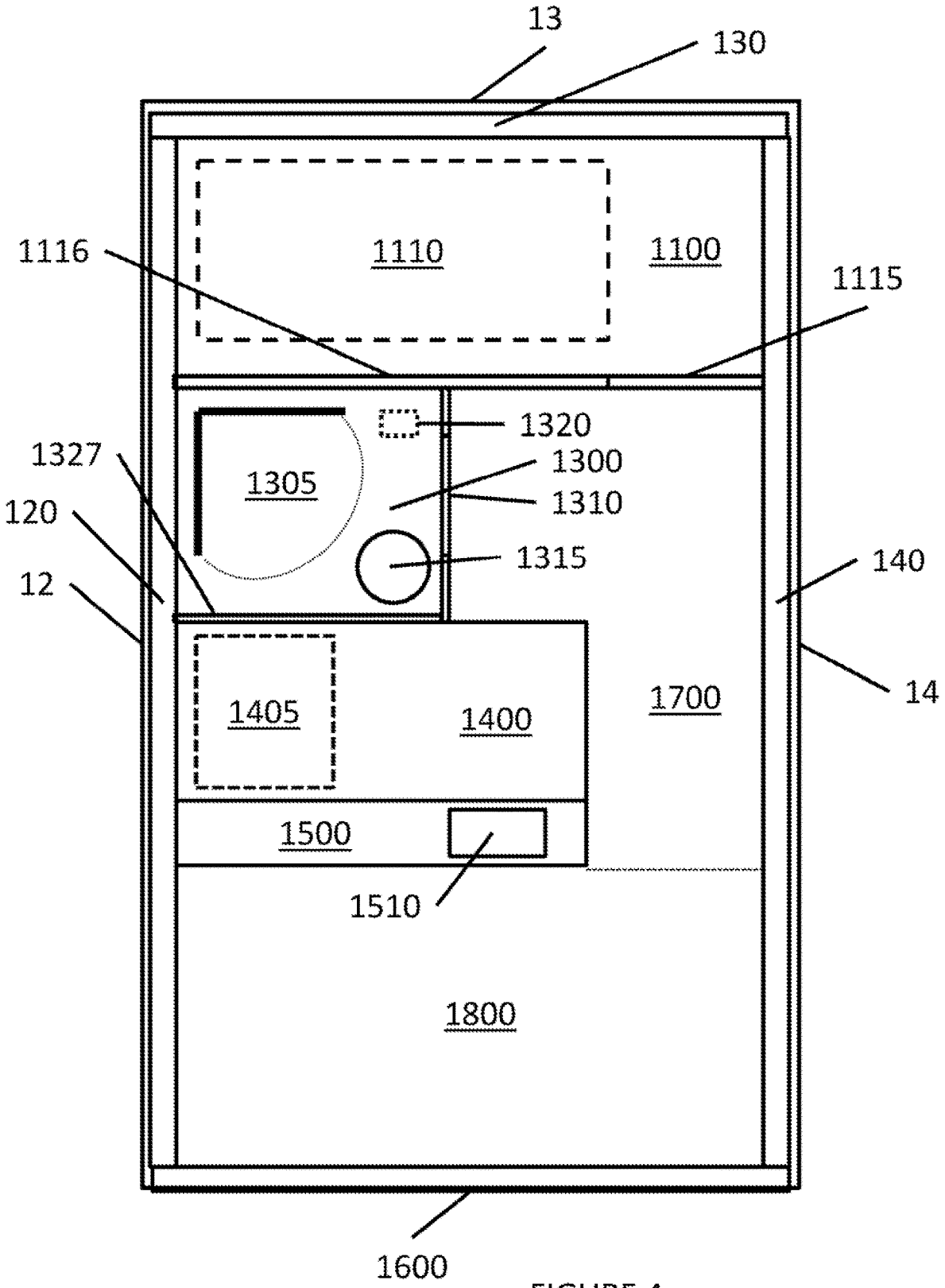
FIG. 4 illustrates a top view of an interior of a pre-constructed portable temporary/relief housing unit based upon a shipping container along line A of FIG. 2.

FIG. 4 illustrates a top view of an interior of a pre-constructed portable temporary/relief housing unit based upon a shipping container along line A of FIG. 2. As illustrated in FIG. 4, the pre-constructed portable temporary/relief housing unit includes a back interior wall 130 connected to the back wall 13 of the shipping container 10, a first interior wall 120 connected to the first side wall 12 of the shipping container 10, and a second interior wall 140 connected to a second side wall 14 of the shipping container 10. These interior walls may constructed of wood paneling and be insulated. The interior walls are thick enough to provide space to run plumbing, electrical conduit, and air ducts, as needed.

In the pre-constructed portable temporary/relief housing unit of FIG. 4, the back wall 13 of the shipping container 10, the second side wall 14 of the shipping container 10, and the first side wall 12 of the shipping container 10 do not include and openings cut therein. Therefore the structural integrity of the back wall 13 of the shipping container 10, the second side wall 14 of the shipping container 10, and the first side wall 12 of the shipping container 10 is maintained and not comprised by cutting openings therein.

The pre-constructed portable temporary/relief housing unit includes a sleeping nook 1100 that may include a mattress 1110. The sleeping nook 1100 includes a privacy door 1115, wall 1116, and a platform (not shown).

As noted above, the pre-constructed portable temporary/relief housing unit includes plumbing for providing fresh water and for removing waste water from the pre-constructed portable temporary/relief housing unit. The waste water removed by the plumbing is drained from the front of pre-constructed portable temporary/relief housing unit, through the entry wall unit 1600.

The plumbing may include a diversion switch under each sink that, when in a first position, allows the grey waste water from the sink to a container, located under the sink or near the sink, so that this grey waste water can be removed from the pre-constructed portable temporary/relief housing unit manually. If the diversion switch is in a second position, the grey waste water from the sink is emptied into the plumbing for removing waste water from the pre-constructed portable temporary/relief housing unit, through the entry wall unit 1600.

The pre-constructed portable temporary/relief housing unit also includes a bathroom 1300 that includes a toilet 1315 a privacy door 1310, and a wall 1327. The black waste water from the toilet 1315 is drained into the plumbing within the pre-constructed portable temporary/relief housing unit. The plumbing may connected directly to a local sewer system or may be connected to a collection container, located outside the pre-constructed portable temporary/relief housing unit, for collecting the black waste water removed from the pre-constructed portable temporary/relief housing unit until it be transferred to a waste water collection system.

The bathroom 1300 may include a shower 1305 and/or a sink 1320. The sink 1320 may include a diversion switch (not shown) and a collection container (not shown) for collecting the grey waste water to be manually removed from the pre-constructed portable temporary/relief housing unit. This collection container may be accessed from under the sink or from an access point under the floor of the bathroom 1300 wherein the bathroom 1300 is a step up bathroom.

The pre-constructed portable temporary/relief housing unit includes a cabinet/storage unit 1400 that provides storage space for the water tank and other mechanics for the pre-constructed portable temporary/relief housing unit. The cabinet/storage unit 1400 may also provide storage space for the occupant of the pre-constructed portable temporary/relief housing unit. The cabinet/storage unit 1400 does not necessarily extend from the floor to the ceiling, thereby allowing the cabinet/storage unit 1400 to include a horizontal surface where small appliances, such as a small fridge 1405, can be placed.

The pre-constructed portable temporary/relief housing unit includes a cabinet/storage unit 1500 that provides storage space the occupant of the pre-constructed portable temporary/relief housing unit and a sink 1510. The sink unit 1510 includes a collection container for collecting the waste water to be removed from the pre-constructed portable temporary/relief housing unit.

As illustrated in FIG. 4, the pre-constructed portable temporary/relief housing unit includes a living space 1800 and a L-shaped hallway 1700 to enable access to the bathroom 1300 and the sleeping nook 1100.

Figure 5:
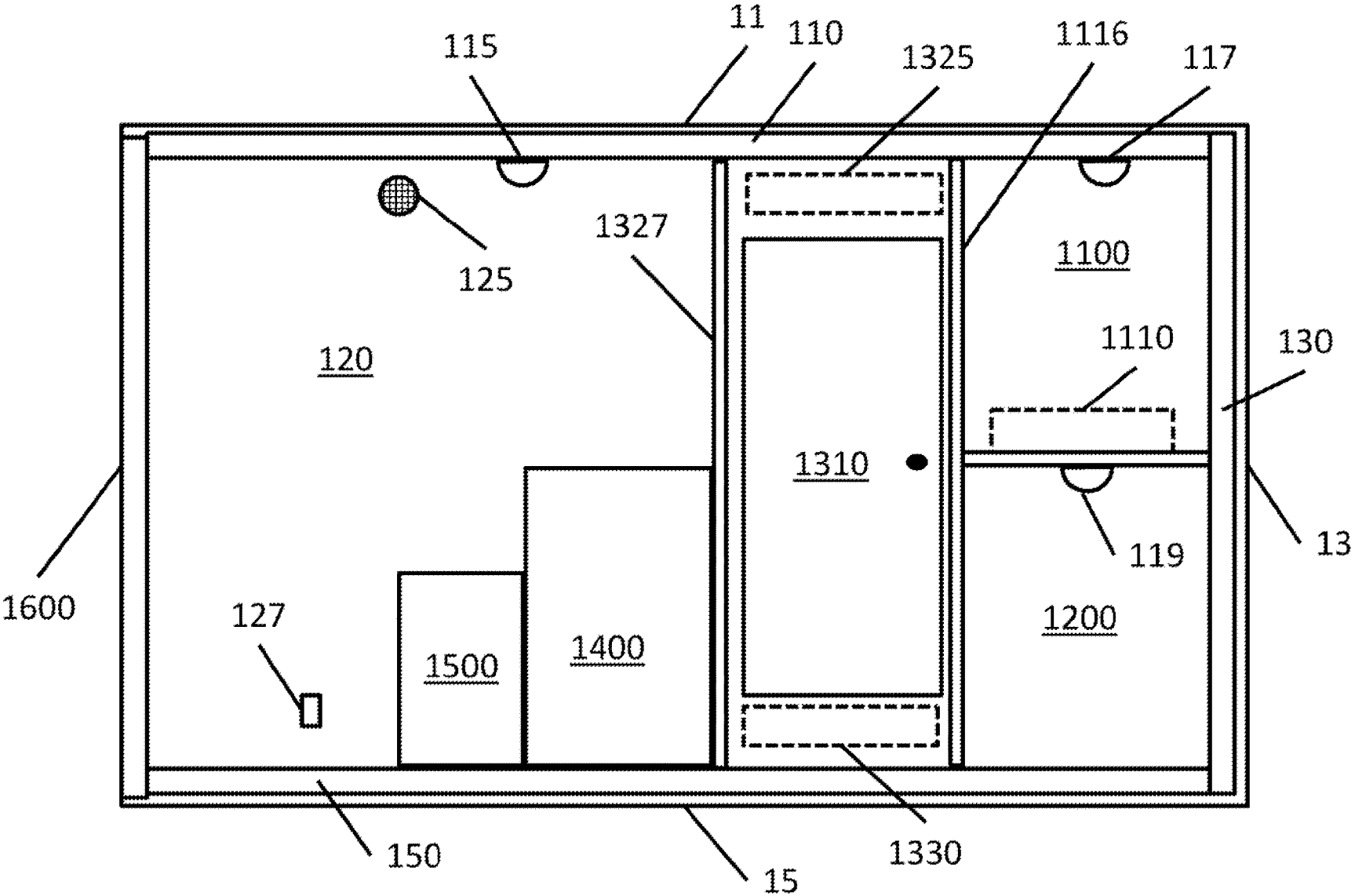
FIG. 5 illustrates a side view of an interior of a pre-constructed portable temporary/relief housing unit based upon a shipping container along line B of FIG. 2.

FIG. 5 illustrates a side view of an interior of a pre-constructed portable temporary/relief housing unit based upon a shipping container along line B of FIG. 2. As illustrated in FIG. 5, the pre-constructed portable temporary/relief housing unit includes a sleeping nook 1100 that may include a mattress 1110. The pre-constructed portable temporary/relief housing unit includes a second nook 1200, which may be utilized as a sleeping nook or a storage nook.

The sleeping nook 1100 may include a light 117, and the second nook 1200 may include a light 119.

As illustrated in FIG. 5, the pre-constructed portable temporary/relief housing unit includes the privacy door 1310 for the bathroom. The bathroom may include access points 1325 and 1330, above the ceiling of the bathroom and below the floor of the bathroom, respectively.

The pre-constructed portable temporary/relief housing unit includes an interior floor 150 connected to the bottom wall 15 of the shipping container 10 and an interior ceiling 110 connected to the top wall 11 of the shipping container 10.

In the pre-constructed portable temporary/relief housing unit of FIG. 5, the bottom wall 15 of the shipping container 10 and the top wall 11 of the shipping container 10 do not include and openings cut therein. Therefore the structural integrity of the bottom wall 15 of the shipping container 10 and the top wall 11 of the shipping container 10 is maintained and not comprised by cutting openings therein.

The interior ceiling and floor may constructed of wood paneling and be insulated. The interior ceiling and floor are thick enough to provide space to run plumbing, electrical conduit, and air ducts, as needed.

The interior ceiling 110 includes a light 115. The first interior wall 120 includes an air outlet 125 and a power outlet 127.

Figure 6:
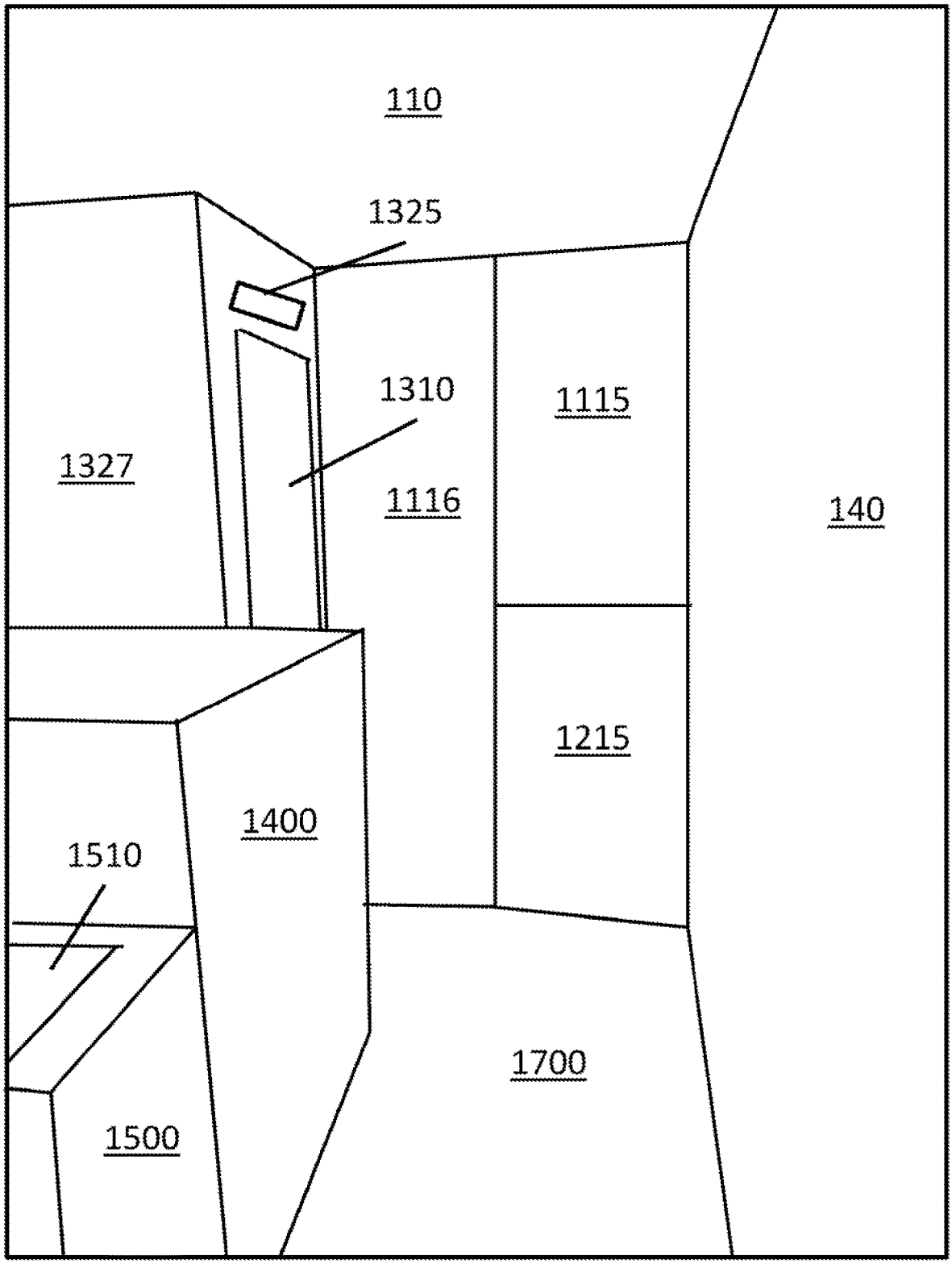
FIGS. 6 through 13 illustrate various views of an interior of a pre-constructed portable temporary/relief housing unit based upon a shipping container.

FIG. 6 illustrates a view of an interior of a pre-constructed portable temporary/relief housing unit based upon a shipping container. As illustrated in FIG. 6, the pre-constructed portable temporary/relief housing unit includes privacy doors 1115 and 1215 for access to sleeping nook 1100 and second nook 1200, respectively.

FIG. 6 also shows the walls 1116 and 1327, the cabinet/storage unit 1400, cabinet/storage unit 1500, sink 1510, second interior wall 140, and L-shaped hallway 1700.

Figure 7:
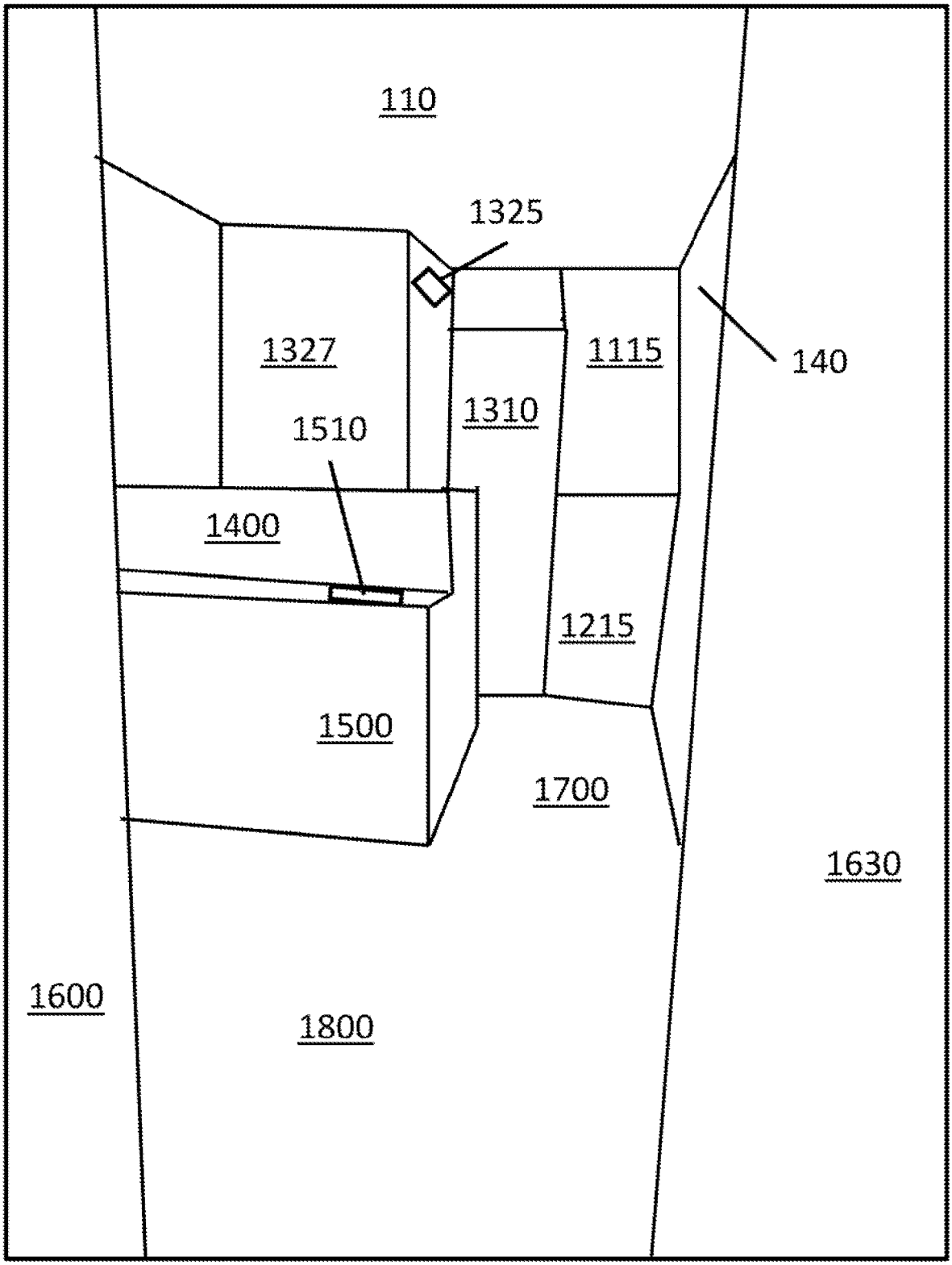

FIG. 7 illustrates another view of an interior of a pre-constructed portable temporary/relief housing unit based upon a shipping container. As illustrated in FIG. 7, the pre-constructed portable temporary/relief housing unit includes privacy doors 1115 and 1215 for access to sleeping nook 1100 and second nook 1200, respectively.

FIG. 7 also shows the wall 1327, interior ceiling 110, the cabinet/storage unit 1400, cabinet/storage unit 1500, sink 1510, L-shaped hallway 1700, door 1630, and living space 1800.

Figure 8:
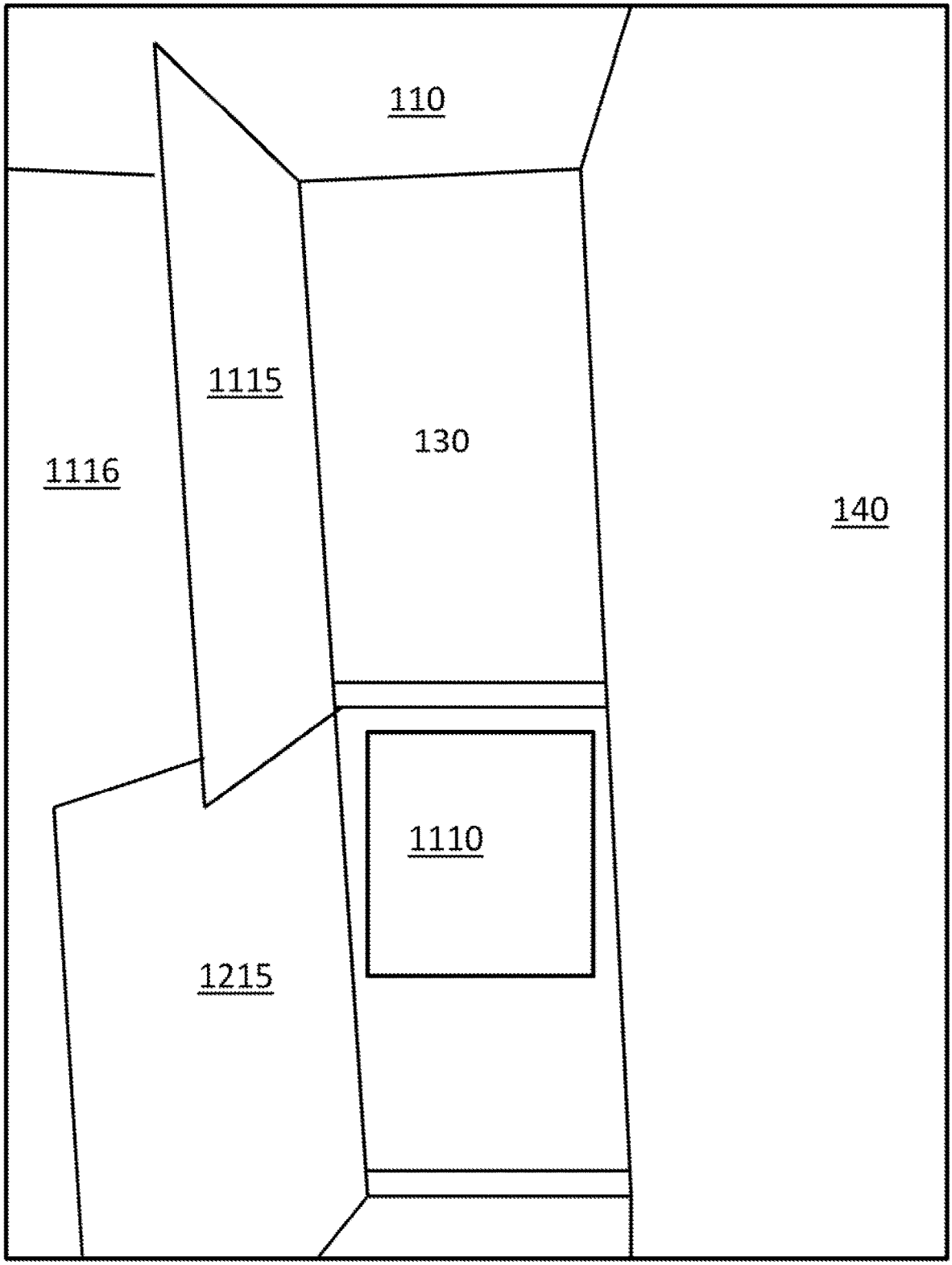

FIG. 8 illustrates another view of an interior of a pre-constructed portable temporary/relief housing unit based upon a shipping container. As illustrated in FIG. 8, the pre-constructed portable temporary/relief housing unit includes privacy doors 1115 and 1215 for access to sleeping nook 1100 and second nook 1200, respectively, that include mattresses 1110. FIG. 8 also shows the wall 1116, interior wall 130, and interior wall 140.

Figure 9:
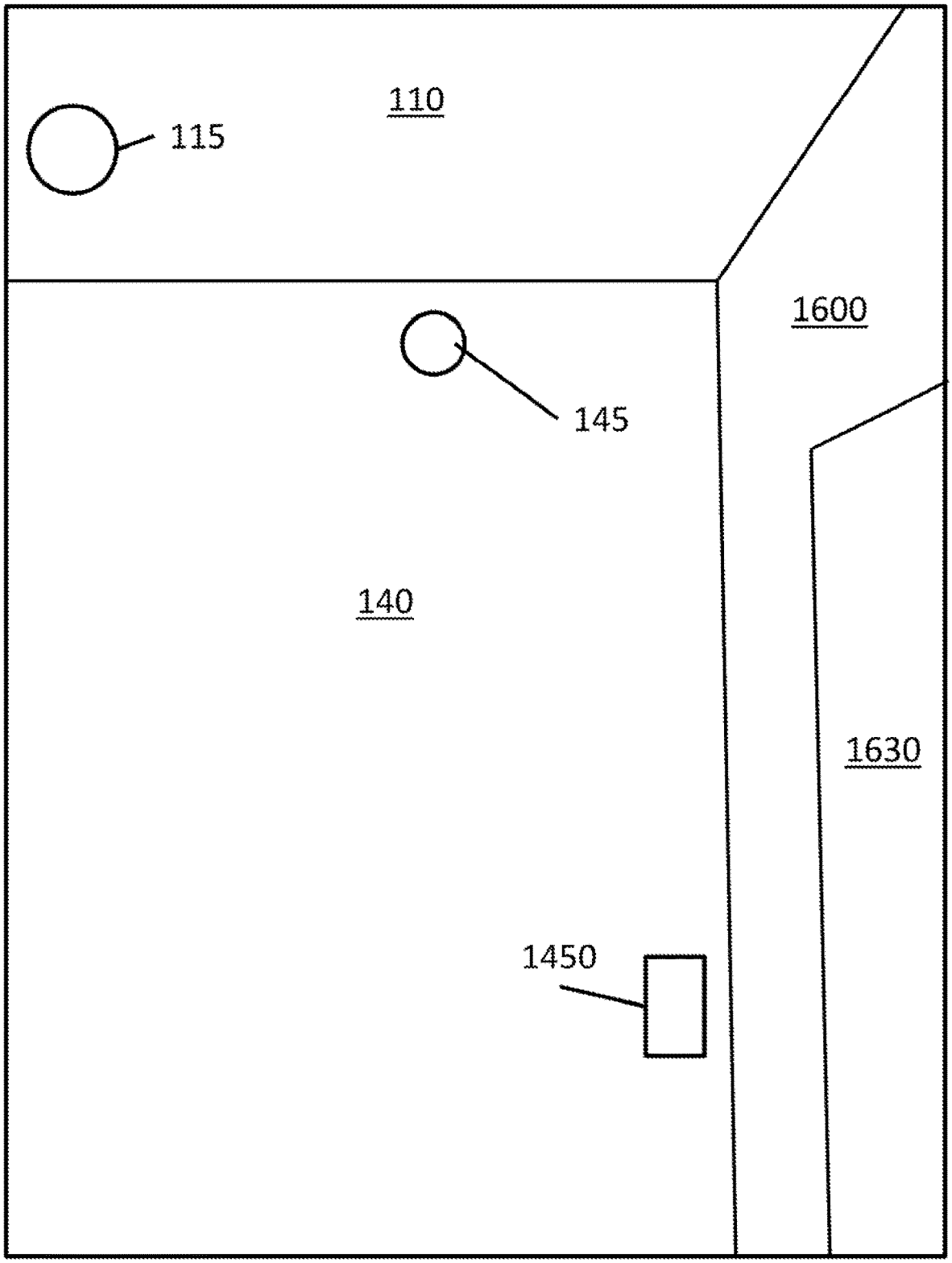

FIG. 9 illustrates another view of an interior of a pre-constructed portable temporary/relief housing unit based upon a shipping container. As illustrated in FIG. 9, the pre-constructed portable temporary/relief housing unit includes interior wall 140 that includes an air outlet 145 a light switch 1450, with a light 115 on the interior ceiling 110.

Figure 10:
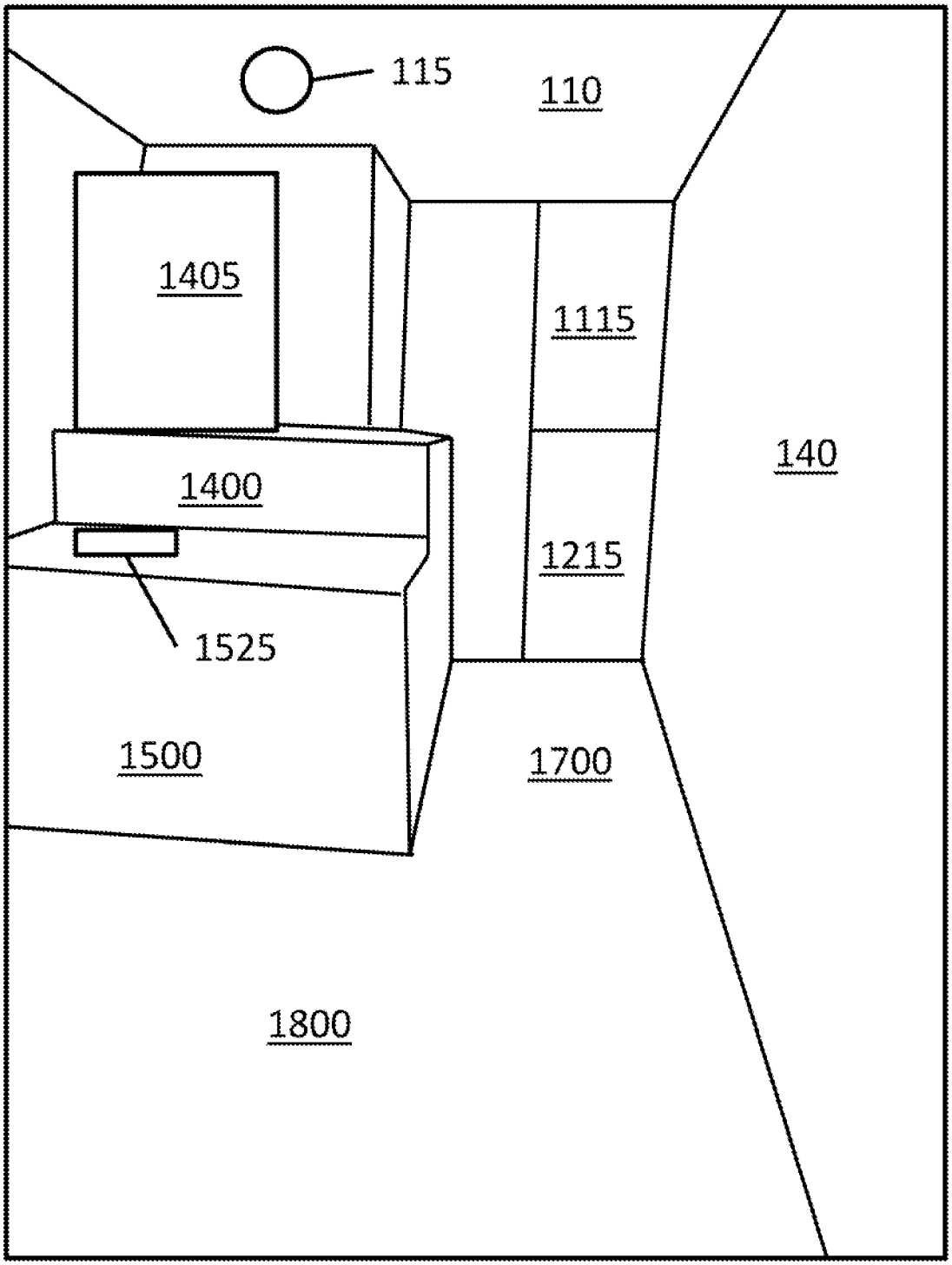

FIG. 10 illustrates a view of an interior of a pre-constructed portable temporary/relief housing unit based upon a shipping container. As illustrated in FIG. 10, the pre-constructed portable temporary/relief housing unit includes privacy doors 1115 and 1215 for access to sleeping nook and second nook, respectively.

FIG. 10 also shows a fridge 1405 on cabinet/storage unit 1400 and a stove unit 1525 on cabinet/storage unit 1500.

As described above, all access points to the pre-constructed portable temporary/relief housing unit are in entry wall unit 1600. The back wall 13 of the shipping container 10, the second side wall 14 of the shipping container 10, the first side wall 12 of the shipping container 10, the bottom wall 15 of the shipping container 10, and the top wall 11 of the shipping container 10 do not include and openings cut therein. Therefore the structural integrity of the back wall 13 of the shipping container 10, the second side wall 14 of the shipping container 10, the first side wall 12 of the shipping container 10, the bottom wall 15 of the shipping container 10, and the top wall 11 of the shipping container 10 is maintained and not comprised by cutting openings therein.

Figure 11:
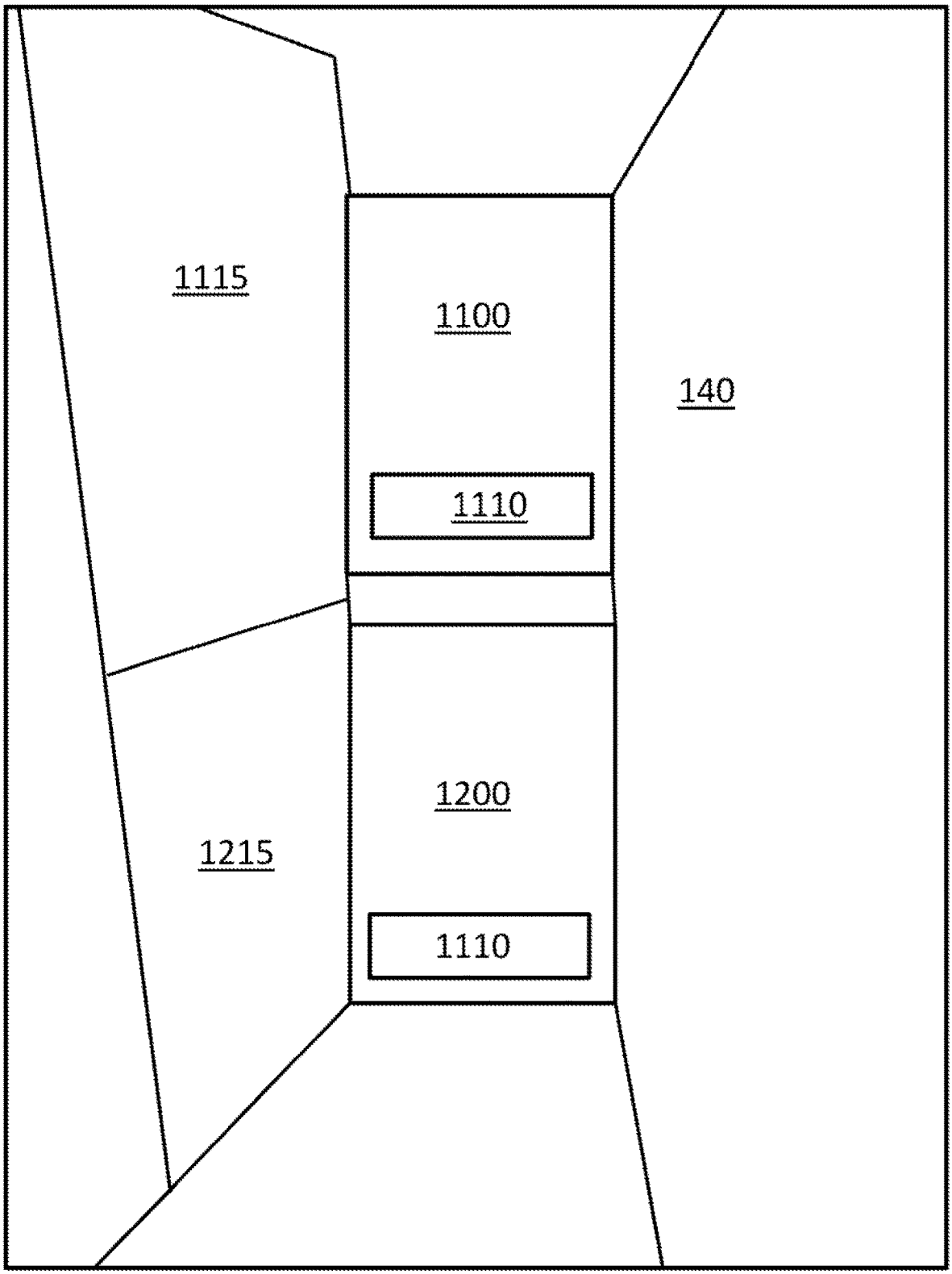

FIG. 11 illustrates another view of an interior of a pre-constructed portable temporary/relief housing unit based upon a shipping container. As illustrated in FIG. 11, the pre-constructed portable temporary/relief housing unit includes privacy doors 1115 and 1215 for access to sleeping nook 1100 and second nook 1200, respectively, that include mattresses 1110. FIG. 11 also shows the side wall 140.

Figure 12:
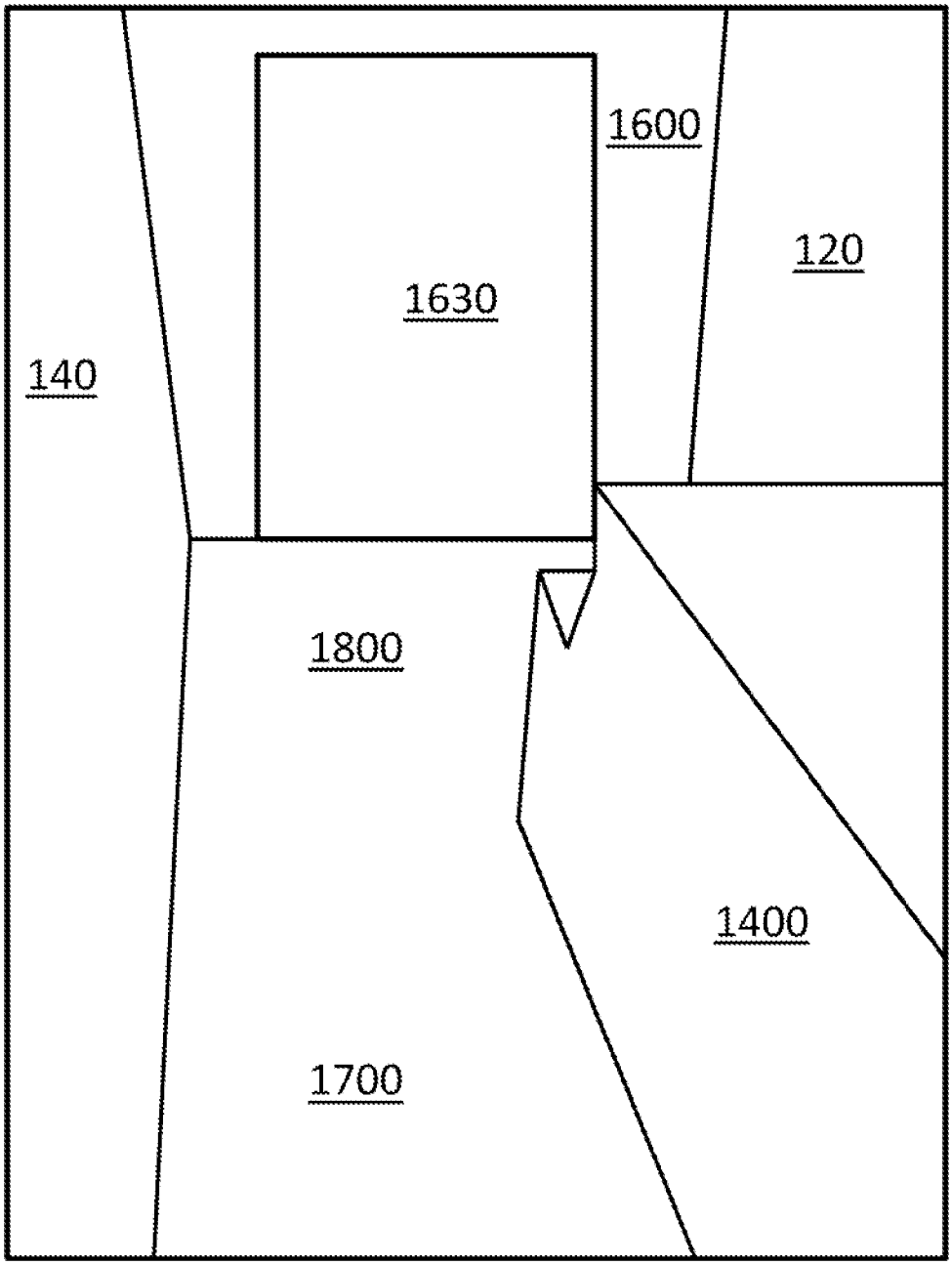

FIG. 12 illustrates another view of an interior of a pre-constructed portable temporary/relief housing unit based upon a shipping container. As illustrated in FIG. 12, the pre-constructed portable temporary/relief housing unit includes door 1630 and cabinet/storage unit 1400. FIG. 12 also shows interior wall 140 and interior wall 120.

FIG. 12 illustrates another view of an interior of a pre-constructed portable temporary/relief housing unit based upon a shipping container. As illustrated in FIG. 12, the pre-constructed portable temporary/relief housing unit includes door 1630 and cabinet/storage unit 1400. FIG. 12 also shows interior wall 140 and interior wall 120.

In another embodiment of a pre-constructed portable temporary/relief housing unit based upon a shipping container, the pre-constructed portable temporary/relief housing unit may include a fridge on cabinet/storage unit and a stove unit on cabinet/storage unit.

Figure 13:
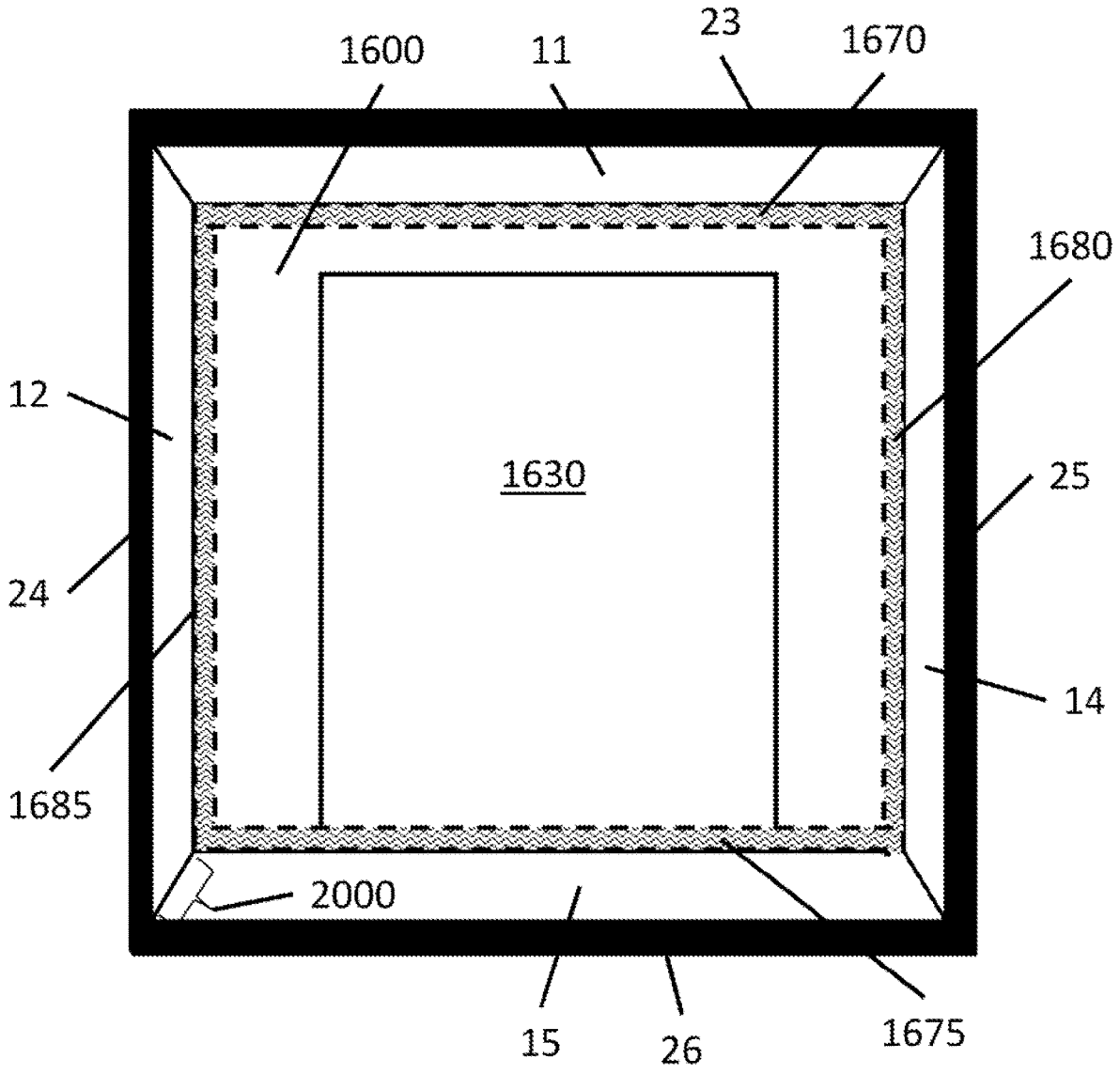

FIG. 13 illustrates a front view of the pre-constructed portable temporary/relief housing unit. As illustrated in FIG. 13, the entry wall unit 1600 may be recessed 2000 from a front edge of the shipping container, formed by shipping container frame members (23, 24, 25, and 26). This recessing 2000 of the entry wall unit 1600 allows the various interfaces to extend out from the entry wall unit 1600 with door 1630 and windows (not shown) and allows the interfaces to be protected by the shipping container frame members (23, 24, 25, and 26) of the shipping container 40 so as not to be damaged by an adjacent shipping container when transporting the shipping container. This recessing 2000 of the entry wall unit 1600 may allow the mounting of an air unit to provide either heat or air conditioning to the interior of the pre-constructed portable temporary/relief housing unit while being protected by the shipping container so as not to be damaged by an adjacent shipping container when transporting the shipping container. The entry wall unit 1600 is connected, via welding, to the steel top wall 11, the steel bottom floor 15, the first steel side wall 12 and the second steel side wall 14. The entry wall unit 1600 may be connected to the steel top wall 11, the steel bottom floor 15, the first steel side wall 12 and the second steel side wall 14, via side steel reinforcement beams 1680 and 1685, a top steel reinforcement beam 1670, and a bottom steel reinforcement beam 1675 constructed within the entry wall unit 1600.

Figure 14:
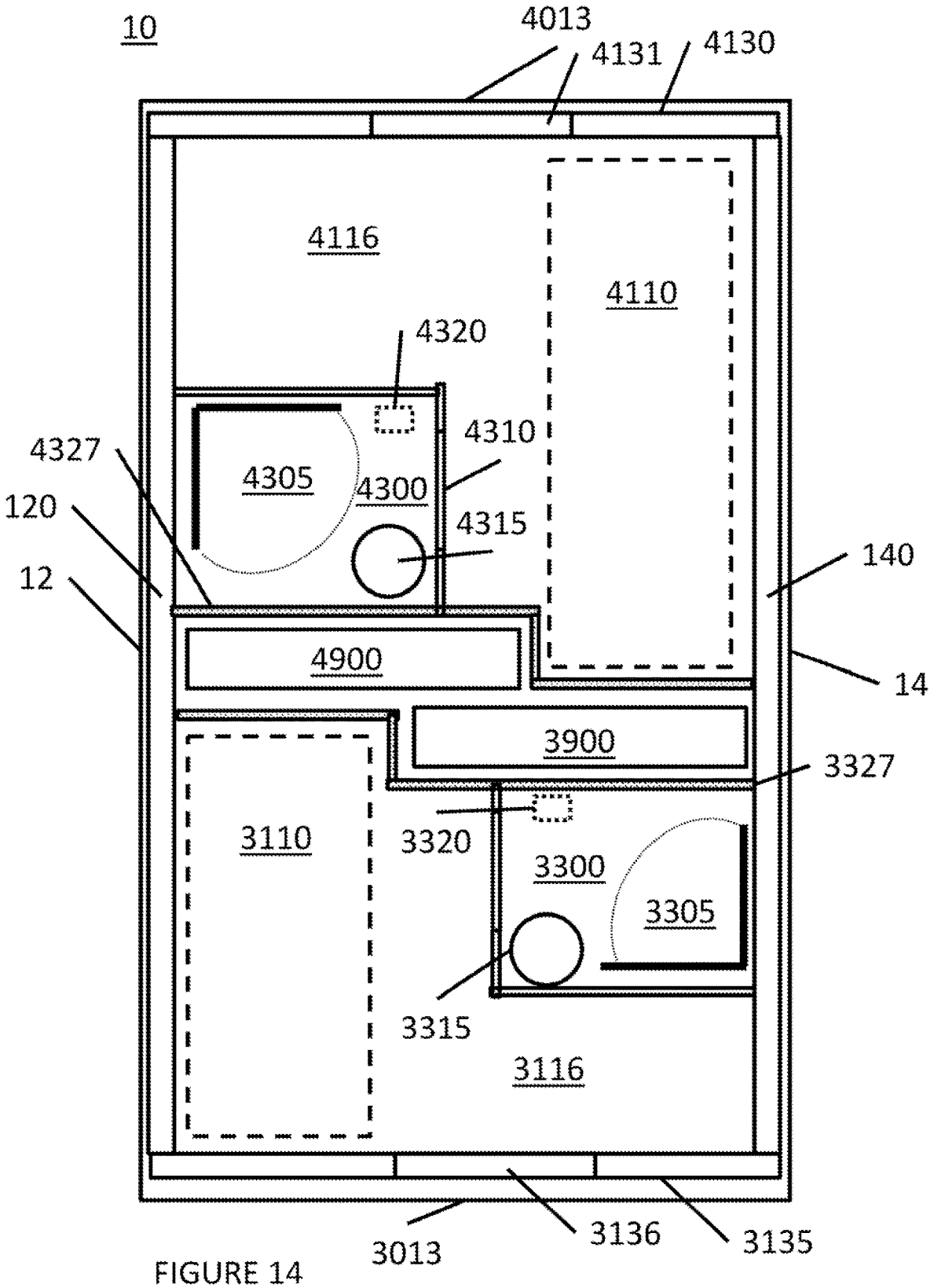
FIG. 14 illustrates a top view of an interior of a pre-constructed portable temporary/relief housing unit based upon a shipping container which contains two living units therein.

FIG. 14 illustrates a top view of an interior of a pre-constructed portable temporary/relief housing unit based upon a shipping container which contains two living units. As illustrated in FIG. 14, the pre-constructed portable temporary/relief housing unit includes an entry wall unit 4130 connected across an opening 4013 of the shipping container 10, a first interior wall 120 connected to a first side wall 12 of the shipping container 10, and a second interior wall 140 connected to a second side wall 14 of the shipping container 10. The pre-constructed portable temporary/relief housing unit also includes an entry wall unit 3135 connected across an opening 3013 of the shipping container 10, a first interior wall 120 connected to a first side wall 12 of the shipping container 10, and a second interior wall 140 connected to a second side wall 14 of the shipping container 10.

These interior walls may constructed of wood paneling and be insulated. The interior walls may be constructed of fire retardant material. The interior walls are thick enough to provide space to run plumbing, electrical conduit, and air ducts, as needed.

In the pre-constructed portable temporary/relief housing unit of FIG. 14, the second side wall 14 of the shipping container 10 and the first side wall 12 of the shipping container 10 do not include and openings cut therein. Therefore, the structural integrity the second side wall 14 of the shipping container 10 and the first side wall 12 of the shipping container 10 is maintained and not comprised by cutting openings therein.

The pre-constructed portable temporary/relief housing unit includes two living spaces 4116 and 3116. The first living space 4116 is defined by the first interior wall 120, entry wall unit 4130, second interior wall 140, and first living space interior wall 4327, which expands between the second interior wall 140 and the first interior wall 120. The first living space 4116 includes a sleeping area 4110 that may include a single bed or bunk beds.

As noted above, the pre-constructed portable temporary/relief housing unit includes plumbing for providing fresh water and for removing waste water from the pre-constructed portable temporary/relief housing unit. The waste water removed by the plumbing can be drained from the pre-constructed portable temporary/relief housing unit, through the entry wall unit 4130. The entry wall unit 4130 includes a door 4131 and may include a window.

The plumbing may include a diversion switch under each sink that, when in a first position, allows the grey waste water from the sink to a container, located under the sink or near the sink, so that this grey waste water can be removed from the pre-constructed portable temporary/relief housing unit manually. If the diversion switch is in a second position, the grey waste water from the sink is emptied into the plumbing for removing waste water from the pre-constructed portable temporary/relief housing unit, through the entry wall unit 4130.

The first living space 4116 of the pre-constructed portable temporary/relief housing unit also includes a bathroom 4300 that includes a toilet 4315 and a privacy door 4310. The black waste water from the toilet 4315 is drained into the plumbing within the pre-constructed portable temporary/relief housing unit.

The plumbing may connected directly to a local sewer system or may be connected to a collection container, located outside the pre-constructed portable temporary/relief housing unit, for collecting the black waste water removed from the pre-constructed portable temporary/relief housing unit until it be transferred to a waste water collection system. The toilet 4315 may be a composting toilet.

The bathroom 4300 may include a shower 4305 and/or a sink 4320. The sink 4320 may include a diversion switch (not shown) and a collection container (not shown) for collecting the grey waste water to be manually removed from the pre-constructed portable temporary/relief housing unit. This collection container may be accessed from under the sink or from an access point under the floor of the bathroom 4300 wherein the bathroom 4300 is a step up bathroom.

The pre-constructed portable temporary/relief housing unit also includes a second living space 3116, which is defined by the first interior wall 120, entry wall unit 3135, second interior wall 140, and second living space interior wall 3327, which expands between the second interior wall 140 and the first interior wall 120. The second living space 3116 includes a sleeping area 3110 that may include a single bed or bunk beds.

As noted above, the pre-constructed portable temporary/relief housing unit includes plumbing for providing fresh water and for removing waste water from the pre-constructed portable temporary/relief housing unit. The waste water removed by the plumbing can be drained from the pre-constructed portable temporary/relief housing unit, through the entry wall unit 3135. The entry wall unit 3135 includes a door 3136 and may include a window.

The plumbing may include a diversion switch under each sink that, when in a first position, allows the grey waste water from the sink to a container, located under the sink or near the sink, so that this grey waste water can be removed from the pre-constructed portable temporary/relief housing unit manually. If the diversion switch is in a second position, the grey waste water from the sink is emptied into the plumbing for removing waste water from the pre-constructed portable temporary/relief housing unit, through the entry wall unit 3135.

The second living space 3116 of the pre-constructed portable temporary/relief housing unit also includes a bathroom 3300 that includes a toilet 3315 and a privacy door 3310. The black waste water from the toilet 3315 is drained into the plumbing within the pre-constructed portable temporary/relief housing unit. The plumbing may connected directly to a local sewer system or may be connected to a collection container, located outside the pre-constructed portable temporary/relief housing unit, for collecting the black waste water removed from the pre-constructed portable temporary/relief housing unit until it be transferred to a waste water collection system. The toilet 3315 may be a composting toilet.

The bathroom 3300 may include a shower 3305 and/or a sink 3320. The sink 4320 may include a diversion switch (not shown) and a collection container (not shown) for collecting the grey waste water to be manually removed from the pre-constructed portable temporary/relief housing unit. This collection container may be accessed from under the sink or from an access point under the floor of the bathroom 3300 wherein the bathroom 3300 is a step up bathroom.

Located between the second living space 3116 and the first living space 4116 are a first fresh water holding tank 4900 (for the first living space 4116) and a second fresh water holding tank 3900 (for the second living space 3116). The first fresh water holding tank 4900 and the second fresh water holding tank 3900 are hidden by second living space interior wall 3327 and first living space interior wall 4327.

As noted above, the pre-constructed portable temporary/relief housing unit is constructed without cutting openings into the walls of the shipping container. Thus, the pre-constructed portable temporary/relief housing unit is constructed without requiring major modifications to the shipping container, thereby retaining its structural integrity.

The entry wall of the pre-constructed portable temporary/relief housing unit can be optionally constructed with steel reinforcement beams to enhance the structural integrity shipping container.

As demonstrated above, the pre-constructed portable temporary/relief housing unit based upon a shipping container includes self-contained electrical and plumbing systems, and further, the pre-constructed portable temporary/relief housing unit includes its own power source (solar panel).

Additionally, the pre-constructed portable temporary/relief housing unit, described above, can be set up in little to no time, wherein the set up time is limited to connecting the solar panel to the power interface or alternatively connecting local utilities to the appropriate interfaces.

Moreover, the pre-constructed portable temporary/relief housing unit, described above, can be re-packed up in little to no time, wherein the re-pack time is limited to disconnecting the solar panel from the power interface or alternatively disconnecting local utilities from the appropriate interfaces.

A transportable modular building comprises a shipping container; the shipping container including shipping container frame members defining an outer periphery of the shipping container, the shipping container frame members being connected to form corners of the shipping container, the shipping container frame members being connected to form a first side, a second side, a third side, a fourth side, a fifth side, and a sixth side of the shipping container, and shipping container periphery walls extending between the shipping container frame members to form a second side periphery wall, a third side periphery wall, a fourth side periphery wall, a fifth side periphery wall, and a sixth side periphery wall of the shipping container, and an entry wall unit extending between the second side periphery wall, the third side periphery wall, the fourth side periphery wall, and the fifth side periphery wall; the entry wall unit being located near the first side; the entry wall unit being recessed from the shipping container frame members forming the first side; the entry wall unit including a door; the entry wall unit including a solar panel power interface to interface with a solar panel; the shipping container being suitable for national and international conveyance using conventional transportation networks.

The entry wall unit may include a plumbing interface configured to receive fresh water into the shipping container and to expel waste water from the shipping container.

The entry wall unit may include a window.

The entry wall unit may include an air interface configured to receive fresh air into the shipping container and to expel stale air from the shipping container.

The entry wall unit may include an AC power interface to interface with an AC power source.

The transportable modular building may comprise interior walls; an interior ceiling; and an interior floor.

The transportable modular building may comprise a sleeping pod; a storage cabinet; and a bathroom.

The entry wall unit may be recessed from the shipping container frame members forming the first side such that the solar panel power interface and the plumbing interface are protected by the shipping container frame members forming the first side so as not to be damaged by an adjacent shipping container when transporting the shipping container.

The transportable modular building may comprise interior lighting. The transportable modular building may comprise a self-contained electrical system and a self-contained plumbing system.

The entry wall unit may be constructed with steel reinforcement beams.

The shipping container frame members may be metal.

The shipping container periphery walls may be metal.

The interior walls may be constructed of fire-retardant material.

The interior ceiling may be constructed of fire-retardant material.

The interior floor may be constructed of fire-retardant material.

The shipping container periphery walls may be constructed without any through holes.

The transportable modular building may comprise a battery based self-contained electrical system.

The transportable modular building may comprise a fresh water tank configured to hold fresh water; a septic tank configured to hold waste water; a self-contained plumbing system; and a pump configured to circulate fresh water in the self-contained plumbing system.

The transportable modular building may comprise a refrigerator and a cooking appliance.

A transportable modular building comprises a shipping container; the shipping container including a first living unit and a second living unit; the shipping container including shipping container frame members defining an outer periphery of the shipping container, the shipping container frame members being connected to form corners of the shipping container, the shipping container frame members being connected to form a first side, a second side, a third side, a fourth side, a top, and a bottom of the shipping container, shipping container periphery walls extending between the shipping container frame members to form a first side periphery wall, a second side periphery wall, a bottom periphery wall, and a top periphery wall of the shipping container, a first entry wall unit extending between the first side periphery wall, the second side periphery wall, the top periphery wall, and the bottom periphery wall, and a second entry wall unit extending between the first side periphery wall, the second side periphery wall, the top periphery wall, and the bottom periphery wall; the first entry wall unit being located near the first side; the second entry wall unit being located near the fourth side; the first entry wall unit being recessed from the shipping container frame members forming the first side; the second entry wall unit being recessed from the shipping container frame members forming the fourth side; the first entry wall unit including a first door; the second entry wall unit including a second door; the first entry wall unit including a first solar panel power interface to interface with a solar panel; the second entry wall unit including a second solar panel power interface to interface with a solar panel; the shipping container including a first living unit interior wall and a second living unit interior wall; the shipping container including a fresh water tank located between the first living unit interior wall and the second living unit interior wall; the shipping container being suitable for national and international conveyance using conventional transportation networks.

The first entry wall unit may include a first window and the second entry wall unit may include a second window.

The first entry wall unit may include a first air interface configured to receive fresh air into the first living unit of the shipping container and to expel stale air from the first living unit of the shipping container and the second entry wall unit may include a second air interface configured to receive fresh air into the second living unit of the shipping container and to expel stale air from the second living unit of the shipping container.

The first entry wall unit may include a first AC power interface to interface with an AC power source and the second entry wall unit may include a second AC power interface to interface with an AC power source.

The first living unit may include interior walls, an interior ceiling, and an interior floor, and the second living unit may include interior walls, an interior ceiling, and an interior floor.

The first living unit may include a first sleeping area and a first bathroom and the second living unit may include a second sleeping area and a second bathroom.

The first entry wall unit may be recessed from the shipping container frame members forming the first side such that the first solar panel power interface is protected by the shipping container frame members forming the first side so as not to be damaged by an adjacent shipping container when transporting the shipping container, and the second entry wall unit may be recessed from the shipping container frame members forming the fourth side such that the second solar panel power interface is protected by the shipping container frame members forming the fourth side so as not to be damaged by an adjacent shipping container when transporting the shipping container.

The first living unit may include interior lighting, and the second living unit may include interior lighting.

The first living unit may include a first self-contained electrical system and a first self-contained plumbing system, and the second living unit may include a second self-contained electrical system and a second self-contained plumbing system.

The first living unit may include a first fresh water tank configured to hold fresh water, a first septic tank configured to hold waste water, a first self-contained plumbing system, and a first pump configured to circulate fresh water in the first self-contained plumbing system, and the second living unit may include a second fresh water tank configured to hold fresh water, a second septic tank configured to hold waste water, a second self-contained plumbing system, and a second pump configured to circulate fresh water in the second self-contained plumbing system.

A transportable modular building comprises a shipping container; the shipping container including shipping container frame members defining an outer periphery of the shipping container, the shipping container frame members being connected to form corners of the shipping container, the shipping container frame members being connected to form a first side, a second side, a third side, a fourth side, a top, and a bottom of the shipping container; the shipping container including shipping container periphery walls extending between the shipping container frame members to form a first side periphery wall associated with the second side of the shipping container, a second side periphery wall associated with the third side of the shipping container, a third periphery wall associated with the fourth side of the shipping container, a bottom periphery wall associated with the bottom of the shipping container, and a top periphery wall associated with the top of the shipping container; the shipping container including an entry wall unit extending between the first side periphery wall, the second side periphery wall, the top periphery wall, and the bottom periphery wall; the entry wall unit being located near the first side of the shipping container; the entry wall unit being recessed from the shipping container frame members forming the first side of the shipping container; the entry wall unit including a door; the entry wall unit including a solar panel power interface to interface with a solar panel; the entry wall unit including a plumbing interface configured to receive fresh water into the shipping container and to expel waste water from the shipping container; the shipping container being suitable for national and international conveyance using conventional transportation networks.

The entry wall unit may include a window.

The entry wall unit may include an air interface configured to receive fresh air into the shipping container and to expel stale air from the shipping container.

The entry wall unit may include an AC power interface to interface with an AC power source.

The transportable modular building may include a first interior wall associated with the first side periphery wall of the shipping container; a second interior wall associated with the second side periphery wall of the shipping container; a first interior wall associated with the third side periphery wall of the shipping container; an interior ceiling associated with the top periphery wall of the shipping container; and an interior floor associated with the bottom periphery wall of the shipping container.

The transportable modular building may include a sleeping pod; a storage cabinet; and a bathroom.

The entry wall unit may be recessed from the shipping container frame members forming the first side of the shipping container such that the solar panel power interface and the plumbing interface are protected by the shipping container frame members forming the first side of the shipping container so as not to be damaged by an adjacent shipping container when transporting the shipping container.

The transportable modular building may include interior lighting.

The transportable modular building may include a self-contained electrical system and a self-contained plumbing system.

The transportable modular building may include a fresh water tank configured to hold fresh water; a septic tank configured to hold waste water; a self-contained plumbing system; and a pump configured to circulate fresh water in the self-contained plumbing system.

A transportable modular building comprises a shipping container; the shipping container including a first living unit and a second living unit; the shipping container including shipping container frame members defining an outer periphery of the shipping container, the shipping container frame members being connected to form corners of the shipping container, the shipping container frame members being connected to form a first side, a second side, a third side, a fourth side, a top, and a bottom of the shipping container; the shipping container including shipping container periphery walls extending between the shipping container frame members to form a first side periphery wall associated with the second side of the shipping container, a second side periphery wall associated with the third side of the shipping container, a top periphery wall associated with the top of the shipping container, and a bottom periphery wall associated with the bottom of the shipping container; the shipping container including a first entry wall unit extending between the first side periphery wall, the second side periphery wall, the top periphery wall, and the bottom periphery wall; the shipping container including a second entry wall unit extending between the first side periphery wall, the second side periphery wall, the top periphery wall, and the bottom periphery wall; the first entry wall unit being located near the first side of the shipping container; the second entry wall unit being located near the fourth side of the shipping container; the first entry wall unit being recessed from the shipping container frame members forming the first side of the shipping container; the second entry wall unit being recessed from the shipping container frame members forming the fourth side of the shipping container; the first entry wall unit including a first door; the second entry wall unit including a second door; the first entry wall unit including a first solar panel power interface to interface with a solar panel; the second entry wall unit including a second solar panel power interface to interface with a solar panel; the shipping container including a first living unit interior wall and a second living unit interior wall; the shipping container including a fresh water tank located between the first living unit interior wall and the second living unit interior wall; the shipping container being suitable for national and international conveyance using conventional transportation networks.

The first entry wall unit may include a first window and the second entry wall unit may include a second window.

The first entry wall unit may include a first air interface configured to receive fresh air into the first living unit of the shipping container and to expel stale air from the first living unit of the shipping container and the second entry wall unit may include a second air interface configured to receive fresh air into the second living unit of the shipping container and to expel stale air from the second living unit of the shipping container.

The first entry wall unit may include a first AC power interface to interface with an AC power source and the second entry wall unit may include a second AC power interface to interface with an AC power source.

The first living unit may include interior walls, an interior ceiling, and an interior floor, and the second living unit may include interior walls, an interior ceiling, and an interior floor.

The first living unit may include a first sleeping area and a first bathroom and the second living unit may include a second sleeping area and a second bathroom.

The first entry wall unit may be recessed from the shipping container frame members forming the first side of the shipping container such that the first solar panel power interface is protected by the shipping container frame members forming the first side of the shipping container so as not to be damaged by an adjacent shipping container when transporting the shipping container, and the second entry wall unit may be recessed from the shipping container frame members forming the fourth side of the shipping container such that the second solar panel power interface is protected by the shipping container frame members forming the fourth side of the shipping container so as not to be damaged by an adjacent shipping container when transporting the shipping container.

The first living unit may include interior lighting and the second living unit may include interior lighting.

The first living unit may include a first self-contained electrical system and a first self-contained plumbing system, and the second living unit may include a second self-contained electrical system and a second self-contained plumbing system.

The first living unit may include a first fresh water tank configured to hold fresh water, a first septic tank configured to hold waste water, a first self-contained plumbing system, and a first pump configured to circulate fresh water in the first self-contained plumbing system, and the second living unit may include a second fresh water tank configured to hold fresh water, a second septic tank configured to hold waste water, a second self-contained plumbing system, and a second pump configured to circulate fresh water in the second self-contained plumbing system.

It will be appreciated that several of the above-disclosed embodiments and other features and functions, or alternatives thereof, may be desirably combined into many other different systems or applications. Also, various presently unforeseen or unanticipated alternatives, modifications, variations, or improvements therein may be subsequently made by those skilled in the art which are also intended to be encompassed by the description above.

What is claimed is:

1. A transportable modular building comprising:

a shipping container;

said shipping container including twelve shipping container frame members defining a frame of an outer periphery of said shipping container, said shipping container frame members being connected to form corners of said shipping container;

a first set of shipping container frame members including a first shipping container frame member, a second shipping container frame member, a third shipping container frame member, and a fourth shipping container frame member;

said first set of shipping container frame members being connected to form a first framed side of said shipping container;

a second set of shipping container frame members including a fifth shipping container frame member, a sixth shipping container frame member, a seventh shipping container frame member, and an eighth shipping container frame member;

said second set of shipping container frame members being connected to form a framed second side of said shipping container;

a third set of shipping container frame members including said second shipping container frame member, a ninth shipping container frame member, a tenth shipping container frame member, and said sixth shipping container frame member;

said third set of shipping container frame members being connected to form a framed third side of said shipping container;

a fourth set of shipping container frame members including said fourth shipping container frame member, an eleventh shipping container frame member, a twelfth shipping container frame member, and said eighth shipping container frame member;

said fourth set of shipping container frame members being connected to form a fourth framed side of said shipping container;

a fifth set of shipping container frame members including said first shipping container frame member, said ninth shipping container frame member, said fifth shipping container frame member, and said eleventh shipping container frame member;

said fifth set of shipping container frame members being connected to form a framed top of said shipping container;

a sixth set of shipping container frame members including said third shipping container frame member, said tenth shipping container frame member, said seventh shipping container frame member, and said twelfth shipping container frame member;

said sixth set of shipping container frame members being connected to form a framed bottom of said shipping container;

said shipping container including five shipping container periphery walls;

a first shipping container periphery wall extending between and being connected to said second set of shipping container frame members;

a second shipping container periphery wall extending between and being connected to said third set of shipping container frame members;

a third shipping container periphery wall extending between and being connected to said fourth set of shipping container frame members;

a top shipping container periphery wall extending between and being connected to said fifth set of shipping container frame members;

a bottom shipping container periphery wall extending between and being connected to said sixth set of shipping container frame members;

said shipping container including an opening, said opening defined by said first set of shipping container frame members and by an edge of said second shipping container periphery wall, an edge of said third shipping container periphery wall, an edge of said top shipping container periphery wall, and an edge of said bottom shipping container periphery wall;

said shipping container including an entry wall unit located near said opening and near said first set of shipping container frame members;

said entry wall unit not being directly attached to said first set of shipping container frame members;

said entry wall unit being attached to said first shipping container periphery wall, said second shipping container periphery wall, said top shipping container periphery wall, and said bottom shipping container periphery wall;

said entry wall unit being located within said shipping container and within said opening of said shipping container;

said entry wall unit being recessed from said first set of said shipping container frame members forming said first framed side of said shipping container;

said entry wall unit including a door;

said entry wall unit including a solar panel power interface to interface with a solar panel;

said entry wall unit including a plumbing interface configured to receive fresh water into said shipping container and to expel waste water from said shipping container;

said solar panel power interface and said plumbing interface being located on said entry wall unit such that said first set of said shipping container frame members protect said solar panel power interface and said plumbing interface from being damaged by an adjacent shipping container when transporting said shipping container;

said shipping container being suitable for national and international conveyance using conventional transportation networks.

2. The transportable modular building as claimed in claim 1, wherein said entry wall unit includes a window.

3. The transportable modular building as claimed in claim 1, wherein said entry wall unit includes an air interface configured to receive fresh air into said shipping container and to expel stale air from said shipping container.

4. The transportable modular building as claimed in claim 1, wherein said entry wall unit includes an AC power interface to interface with an AC power source.

5. The transportable modular building as claimed in claim 1, further comprising:

a first interior wall associated with said first shipping container periphery wall of said shipping container;

a second interior wall associated with said second shipping container periphery wall of said shipping container;

a third interior wall associated with said third shipping container periphery wall of said shipping container;

an interior ceiling associated with said top shipping container periphery wall of said shipping container; and an interior floor associated with said bottom shipping container periphery wall of said shipping container.

6. The transportable modular building as claimed in claim 5, further comprising:

a sleeping pod;

a storage cabinet; and a bathroom.

7. The transportable modular building as claimed in claim 1, further comprising interior lighting.

8. The transportable modular building as claimed in claim 1, further comprising:

a self-contained electrical system; and a self-contained plumbing system.

9. The transportable modular building as claimed in claim 1, further comprising:

a fresh water tank configured to hold fresh water;

a septic tank configured to hold waste water;

a self-contained plumbing system; and a pump configured to circulate fresh water in said self-contained plumbing system.

10. A transportable modular building comprising:

a shipping container;

said shipping container including a first living unit and a second living unit;

said shipping container including twelve shipping container frame members defining a frame of an outer periphery of said shipping container, said shipping container frame members being connected to form corners of said shipping container;

a first set of shipping container frame members including a first shipping container frame member, a second shipping container frame member, a third shipping container frame member, and a fourth shipping container frame member;

said first set of shipping container frame members being connected to form a first framed side of said shipping container;

a second set of shipping container frame members including a fifth shipping container frame member, a sixth shipping container frame member, a seventh shipping container frame member, and an eighth shipping container frame member;

said second set of shipping container frame members being connected to form a framed second side of said shipping container;

a third set of shipping container frame members including said second shipping container frame member, a ninth shipping container frame member, a tenth shipping container frame member, and said sixth shipping container frame member;

said third set of shipping container frame members being connected to form a framed third side of said shipping container;

a fourth set of shipping container frame members including said fourth shipping container frame member, an eleventh shipping container frame member, a twelfth shipping container frame member, and said eighth shipping container frame member;

said fourth set of shipping container frame members being connected to form a fourth framed side of said shipping container;

a fifth set of shipping container frame members including said first shipping container frame member, said ninth shipping container frame member, said fifth shipping container frame member, and said eleventh shipping container frame member;

said fifth set of shipping container frame members being connected to form a framed top of said shipping container;

a sixth set of shipping container frame members including said third shipping container frame member, said tenth shipping container frame member, said seventh shipping container frame member, and said twelfth shipping container frame member;

said sixth set of shipping container frame members being connected to form a framed bottom of said shipping container;

said shipping container including four shipping container periphery walls;

a first shipping container periphery wall extending between and being connected to said third set of shipping container frame members;

a second shipping container periphery wall extending between and being connected to said fourth set of shipping container frame members;

a top shipping container periphery wall extending between and being connected to said fifth set of shipping container frame members;

a bottom shipping container periphery wall extending between and being connected to said sixth set of shipping container frame members;

said shipping container including a first opening, said opening defined by said first set of shipping container frame members and defined by edges of said second shipping container periphery wall, said third shipping container periphery wall, said top shipping container periphery wall, and said bottom shipping container periphery wall;

said shipping container including a second opening, said opening defined by said second set of shipping container frame members and defined by edges of said second shipping container periphery wall, said third shipping container periphery wall, said top shipping container periphery wall, and said bottom shipping container periphery wall;

said shipping container including a first entry wall unit located near said first opening and near said first set of shipping container frame members;

said first entry wall unit not being directly attached to said first set of shipping container frame members;

said first entry wall unit being attached to said first shipping container periphery wall, said second shipping container periphery wall, said top shipping container periphery wall, and said bottom shipping container periphery wall;

said shipping container including a second entry wall unit located near said second opening and near said second set of shipping container frame members;

said second entry wall unit not being directly attached to said second set of said shipping container frame members;

said second entry wall unit being attached to said first shipping container periphery wall, said second shipping container periphery wall, said top shipping container periphery wall, and said bottom shipping container periphery wall;

said first entry wall unit being located within said shipping container and being recessed from said first set of shipping container frame members forming said first framed side of said shipping container;

said second entry wall unit being located within said shipping container and being recessed from said second set of shipping container frame members forming said second framed side of said shipping container;

said first entry wall unit including a first door;

said second entry wall unit including a second door;

said first entry wall unit including a first solar panel power interface to interface with a solar panel;

said first solar panel power interface being located on said first entry wall unit such that said first set of shipping container frame members protect said first solar panel power interface from being damaged by an adjacent shipping container when transporting said shipping container;

said second entry wall unit including a second solar panel power interface to interface with a solar panel;

said second solar panel power interface being located on said second entry wall unit such that said second set of shipping container frame members protect said second solar panel power interface from being damaged by an adjacent shipping container when transporting said shipping container;

said shipping container including a first living unit interior back wall and a second living unit interior back wall;

said first living unit interior back wall being attached to said first shipping container periphery wall, said second shipping container periphery wall, said top shipping container periphery wall, and said bottom shipping container periphery wall;

said second living unit interior back wall being attached to said first shipping container periphery wall, said second shipping container periphery wall, said top shipping container periphery wall, and said bottom shipping container periphery wall;

said shipping container including a fresh water tank located between said first living unit interior back wall and said second living unit interior back wall;

said shipping container being suitable for national and international conveyance using conventional transportation networks.

11. The transportable modular building as claimed in claim 10, wherein said first entry wall unit includes a first air interface configured to receive fresh air into said first living unit of said shipping container and to expel stale air from said first living unit of said shipping container and said second entry wall unit includes a second air interface configured to receive fresh air into said second living unit of said shipping container and to expel stale air from said second living unit of said shipping container.

12. The transportable modular building as claimed in claim 10, wherein said first entry wall unit includes a first AC power interface to interface with an AC power source and said second entry wall unit includes a second AC power interface to interface with an AC power source.

13. The transportable modular building as claimed in claim 10, wherein said first living unit includes first living unit interior side walls, a first living unit interior ceiling, and a first living unit interior floor, and said second living unit includes second living unit interior side walls, a second living unit interior ceiling, and a second living unit interior floor.

14. The transportable modular building as claimed in claim 13, wherein said first living unit includes a first sleeping area and a first bathroom and said second living unit includes a second sleeping area and a second bathroom.

15. The transportable modular building as claimed in claim 10, wherein said first living unit includes first living unit interior lighting and said second living unit includes second living unit interior lighting.

16. The transportable modular building as claimed in claim 10, wherein said first living unit includes a first self-contained electrical system and a first self-contained plumbing system, and said second living unit includes a second self-contained electrical system and a second self-contained plumbing system.

17. The transportable modular building as claimed in claim 10, wherein said first living unit includes a first septic tank configured to hold waste water, a first self-contained plumbing system, and a first pump configured to circulate fresh water in said first self-contained plumbing system, and said second living unit includes a second fresh water tank configured to hold fresh water, a second septic tank configured to hold waste water, a second self-contained plumbing system, and a second pump configured to circulate fresh water in said second self-contained plumbing system.

18. A transportable modular building comprising:

a shipping container;

said shipping container including a first shipping container periphery wall, a second shipping container periphery wall, a third shipping container periphery wall, a top shipping container periphery wall, and a bottom shipping container periphery wall;

said shipping container including an opening, said opening being defined by edges of said second shipping container periphery wall, said third shipping container periphery wall, said top shipping container periphery wall, and said bottom shipping container periphery wall;

said shipping container including an entry wall unit;

said entry wall unit including a first side steel reinforcement beam and a second side steel reinforcement beam, said first and second side steel reinforcement beams being configured to provide vertical strength to said entry wall unit;

said entry wall unit including a top steel reinforcement beam and a bottom steel reinforcement beam, said top and bottom steel reinforcement beams being configured to provide horizontal strength to said entry wall unit;

said first and second side steel reinforcement beams being attached to said second shipping container periphery wall and said third shipping container periphery wall;

said top steel reinforcement beam being attached to said top shipping container periphery wall;

said bottom steel reinforcement beam being attached to said bottom shipping container periphery wall;

said entry wall unit being located within said shipping container and being recessed from said opening;

said entry wall unit including a door;

said entry wall unit including a solar panel power interface to interface with a solar panel;

said entry wall unit including a plumbing interface configured to receive fresh water into said shipping container and to expel waste water from said shipping container;

said solar panel power interface and said plumbing interface being located on said entry wall unit such that said second shipping container periphery wall, said third shipping container periphery wall, said top shipping container periphery wall, and said bottom shipping container periphery wall protect said solar panel power interface and said plumbing interface from being damaged by an adjacent shipping container when transporting said shipping container;

said shipping container being suitable for national and international conveyance using conventional transportation networks.

* * * * *